US007027759B2

(12) United States Patent
Kabata et al.

(10) Patent No.: US 7,027,759 B2
(45) Date of Patent: Apr. 11, 2006

(54) APPARATUS HAVING ENDLESS BELT WITH ROUGHENED GUIDE

(75) Inventors: Toshiyuki Kabata, Yokohama (JP); Michio Kimura, Numazu (JP); Hideo Nakamori, Numazu (JP); Shinji Nousyo, Numazu (JP); Akihiro Sugino, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/940,815

(22) Filed: Sep. 15, 2004

(65) Prior Publication Data

US 2005/0031377 A1 Feb. 10, 2005

Related U.S. Application Data

(62) Division of application No. 10/151,109, filed on May 21, 2002, now Pat. No. 6,816,691.

(30) Foreign Application Priority Data

May 21, 2001 (JP) ..... 2001-150955
May 21, 2001 (JP) ..... 2001-151074
Jun. 5, 2001 (JP) ..... 2001-170111
Jun. 7, 2001 (JP) ..... 2001-172671

(51) Int. Cl.
*G03G 15/00* (2006.01)

(52) U.S. Cl. ..... 399/165; 399/164

(58) Field of Classification Search ..... 399/162, 399/165, 164, 303, 313
See application file for complete search history.

(56) References Cited

U.S. PATENT DOCUMENTS 4,282,297 A * 8/1981 Fotland
4,862,211 A * 8/1989 Kutami et al. ..... 399/165
5,339,138 A 8/1994 Mishima et al.
5,342,718 A 8/1994 Nousho et al.
5,348,818 A 9/1994 Asami et al.
5,427,880 A 6/1995 Tamura et al.
5,436,092 A 7/1995 Ohtsuka et al.
5,437,943 A 8/1995 Fujii et al.
5,489,492 A 2/1996 Asami et al.
5,608,010 A 3/1997 Tamura et al.
5,670,284 A 9/1997 Kishi et al.
5,885,733 A 3/1999 Ohsawa et al.
5,900,336 A 5/1999 Kabata et al.
5,991,573 A 11/1999 Nohsho et al.
6,013,393 A 1/2000 Taniuchi et al.
6,074,794 A 6/2000 Fushimi et al.
6,183,926 B1 2/2001 Kuroda et al.

(Continued)

FOREIGN PATENT DOCUMENTS

JP 59-230950 12/1984

(Continued)

OTHER PUBLICATIONS

U.S. Appl. No. 11/105,405, filed date Apr. 14, 2005, Kabata et al.

*Primary Examiner*—Susan Lee
(74) *Attorney, Agent, or Firm*—Oblon, Spivak, McClelland, Maier & Neustadt, P.C.

(57) ABSTRACT

An endless belt including an endless body having opposite side edges and an interior surface, and a pair of spaced apart parallel guides bonded to the interior surface of the endless body at positions adjacent to the side edges thereof and extending longitudinally along the side edges, wherein each of the guides is made of an elastic material and has inside and/or outside surfaces having specific roughness.

16 Claims, 2 Drawing Sheets

U.S. PATENT DOCUMENTS

| | | | |
|---|---|---|---|
| 6,212,351 | B1 | 4/2001 | Kawagoe et al. |
| 6,258,502 | B1 | 7/2001 | Nakamura et al. |
| 6,269,228 | B1 | 7/2001 | Kayahara et al. |
| 6,303,258 | B1 | 10/2001 | Katoh et al. |
| 6,314,264 | B1 * | 11/2001 | Iida et al. |
| 6,363,229 | B1 | 3/2002 | Shiraishi et al. |
| 6,405,002 | B1 | 6/2002 | Ogiyama et al. |
| 6,445,900 | B1 | 9/2002 | Fukao et al. |
| 6,449,453 | B1 | 9/2002 | Motohashi |
| 6,505,024 | B1 | 1/2003 | Kayahara et al. |
| 6,534,227 | B1 | 3/2003 | Kabata et al. |
| 6,600,889 | B1 | 7/2003 | Hiroki et al. |

FOREIGN PATENT DOCUMENTS

| | | | | |
|---|---|---|---|---|
| JP | 03219259 | A | | 9/1991 |
| JP | 4-190280 | | | 7/1992 |
| JP | 04310741 | A | | 11/1992 |
| JP | 04333457 | A | | 11/1992 |
| JP | 05224447 | A | | 9/1993 |
| JP | 09034286 | A | | 2/1997 |
| JP | 2000-1237 | | | 1/2000 |
| JP | 2000-001237 | A | * | 1/2000 |
| JP | 2000001237 | A | | 1/2000 |
| JP | 2000029326 | A | | 1/2000 |
| JP | 2000-132001 | | | 5/2000 |
| JP | 2000-132001 | A | * | 5/2000 |
| JP | 2000131998 | A | | 5/2000 |
| JP | 2000132001 | A | | 5/2000 |
| JP | 2000-289823 | | | 10/2000 |
| JP | 2000-289823 | A | * | 10/2000 |

* cited by examiner

APPARATUS HAVING ENDLESS BELT WITH ROUGHENED GUIDE

This application is a Divisional application of U.S. Ser. No. 10/151,109 filed May 21, 2002, now U.S. Pat. No. 6,816,691.

BACKGROUND OF THE INVENTION

This invention relates to an endless belt, to an endless belt photoconductor, an endless belt and roller structure, and to an image forming apparatus.

In the field of image forming apparatuses such as copying machines and printing machines, there are increasing needs for color-formation, high speed image formation, compact apparatuses and high durability. The use of a large diameter photoconductor drum may satisfy the needs for high speed image formation and high durability but the apparatus becomes unavoidably large in size. The use of an endless belt photoconductor, the shape of which can be easily changed by use of rollers, can solve the above problem.

The endless belt photoconductor generally has a photoconductor layer provided on a support made of an electrically conductive material such as a conductive polymer or a metal. Because of dimensional stability, a metal support is preferably used for an endless belt photoconductor for high speed image formation. An endless belt is supported by a plurality of rollers and adapted to run by rotation of drive roller or rollers. Since each of the rollers for supporting the endless belt is generally not perfectly uniform in diameter throughout the axial length thereof, in sphericity of the cross-sectional shape thereof and in straightness of the axis thereof, the endless belt is apt to laterally move or meander during running. A large lateral movement of the belt may result in disengagement thereof from the rollers and breakage thereof. Further, even when the amplitude of the lateral movement is small, image quality is deteriorated especially when the endless belt photoconductor is used for full color image formation in which a color image is produced by superimposing yellow, cyan and magenta images.

To cope with the problems of lateral movement, there are proposals in which guides are provided on an inside surface of the belt along opposite side edges. The guides are disposed such that at least one of the side walls is in engagement with a side end of at least one of the rollers by which the endless belt is supported. For example, Japanese Laid Open Publication No. S59-230950 proposes an endless belt having guides prepared by applying a hot melt adhesive to an inside surface of the belt along opposite side edges. The melt is then cooled and solidified. Because the guides are apt to deform during the cooling step, however, the thus prepared guides cannot prevent lateral movement of the belt for a long period of operation. Japanese Laid Open Publication No. H04-190280 discloses an endless belt having rubber guides having a specific thickness and a rubber hardness. When the belt is driven at a high linear speed, however, the guides are apt to deform and separate from the belt.

There is also proposed a different type of means for preventing lateral movement of the endless belt, in which a pair of ribs are provided on an inside surface of the belt along opposite side edges. The ribs are disposed for fitting engagement with grooves provided on outer periphery of drive rollers by which the endless belt is supported or for engagement with sloped portions provided at both side ends of drive rollers by which the endless belt is supported. For example, in Japanese Laid Open Publication No. 2000-131998, the inside surface of each of the ribs which is in contact with and bonded to the inner surface of the belt is roughened to have an average surface roughness Ra of at least 0.3 μm to improve adhesion between the rib and the belt. It has been found, however, that when the known endless belt is operated at a high linear speed of, for example, 80 mm/sec or more, there often occurs delamination or separation of the rib from the belt. Japanese Laid Open Publication No. 2000-132001 discloses an endless belt having a pair of ribs bonded to an inner surface of the belt along a side end of the belt. The outer surface of each of the ribs at which the rib is brought into contact with rollers is roughened to have an average surface roughness Ra of at least 0.3 μm to decrease friction therebetween. It has been found, however, that when the known endless belt is operated at a high linear speed of, for example, 80 mm/sec or more, there often occurs lateral movement of the belt. The above endless belt and roller mechanism is also disadvantageous in that it needs the formation of grooves or inclined portions on the rollers.

SUMMARY OF THE INVENTION

It is an object of the present invention to provide an endless belt which has overcome the above problems of the conventional endless belts.

Another object of the present invention is to provide an endless belt of the above-mentioned type which can be driven at a high running speed without lateral movement.

It is a further object of the present invention to provide an endless belt photoconductor suited for a high speed, full color image forming system which is embodied into a compact, high durability apparatus and which can produce full color images free of printing defects attributed to printed color misregistrations attributed to printed color misregistrations in superposed or closely adjacent images.

In accomplishing the foregoing objects, there is provided in accordance with the present invention an endless belt comprising an endless body having opposite side edges and an interior surface, and a pair of spaced apart parallel guides bonded through an adhesive layer to the interior surface of the endless body at positions adjacent to the side edges thereof and extending longitudinally along the side edges, wherein each of the guides is made of an elastic material and has an inside surface which constitutes an interface between the guide and the adhesive layer and which provides I(S) of 0.5–13.0, wherein I(S) is given by the following equations:

$$I(S) = \left(\frac{1}{N}\right)\sum_{n=0}^{N-1}\left\{S\left(\frac{n}{N\cdot\Delta t}\right)\right\}$$

$$S\left(\frac{n}{N\cdot\Delta t}\right) = \frac{1}{N}\cdot\left|X\left(\frac{n}{N\cdot\Delta t}\right)\right|^2$$

$$X\left(\frac{n}{N\cdot\Delta t}\right) = \sum_{m=0}^{N-1} x(m\cdot\Delta t)\exp\left(-i2\pi\cdot\frac{n}{N\cdot\Delta t}\cdot m\cdot\Delta t\right)$$

wherein

N is a number of samples obtained from a sectional curve of the inside surface of the guide and is $2^p$ where p is an integer, Δt is a sampling interval, in μm, at which the N-number of the samples are sampled in the longitudinal direction of the guide, the sectional curve being obtained by measuring a profile of the inside surface of the guide through a preset length N·Δt, x(t) is a height of the sectional curve, in μm, of a sample at a position t in the preset length, and n and m are integers.

The present invention also provides an endless belt comprising an endless body having opposite side edges and an interior surface, and a pair of spaced apart parallel guides bonded through adhesive layers to the interior surface of said endless body at positions adjacent to said side edges thereof and extending longitudinally along said side edges, wherein each of said guides is made of an elastic material and has an inside surface which constitutes an interface between said guide and said adhesive layer and which has Rz of 3–16 μm, wherein Rz is an average surface roughness at ten points of a sectional curve obtained by measuring a profile of the inside surface of said guide in the longitudinal direction of said guide.

The present invention also provides an endless belt and roller structure comprising a plurality of rollers, and one of the above-described endless belts supported by the rollers, so that by rotation of the rollers, the endless belt runs in the longitudinal direction of the guides with a side surface of each of the guides being in contact with a side surface of each of said rollers.

The present invention further provides an image forming apparatus comprising the above endless belt and roller structure.

The present inventors have investigated causes for lowering of image quality when increasing the linear velocity of an endless belt photoconductor to which guides are bonded and found that adhesion between the guides and the belt is one of the important factor with respect to lateral movement of the endless belt photoconductor. It has been also found that the lateral movement can be prevented by controlling surface conditions of the inside surfaces of the guides constituting the interface between the guides and the belt.

The average surface roughness Ra can properly represent magnitude of average unevenness of a sectional curve only when the waves of the sectional curve have similar amplitudes. In actual, however, various waves having various amplitudes and various wavelengths are superimposed one over the other in a sectional curve of a roughened surface. Since minute waves superimposed on waves with large amplitudes are cancelled in calculating Ra and thus are not reflected in Ra at all, surface conditions defined by Ra cannot solve the problem of lateral movement of an endless belt.

The present inventors have investigated a relationship between a sectional curve of a guide bonded to an endless belt photoconductor and the image quality obtained using the photoconductor and have found that waves having relatively small amplitudes as well as waves having large amplitudes largely influence the adhesion of the guide to the belt and, thus, the image quality. The present inventors has also found that a power spectrum obtained by discrete Fourier transformation of a sectional curve of a surface of a guide which provides an interface between the guide and an endless belt represent powers of waves constituting the sectional curve and that it is a total of the powers of all of these waves that properly represent the surface conditions of the guide that give suitable adhesion between the guide and the belt.

The present invention also provides an endless belt comprising an endless body having opposite side edges and an interior surface, and a pair of spaced apart parallel guides fixedly secured to the interior surface of the endless body at positions adjacent to the side edges thereof and extending longitudinally along the side edges, wherein each of the guides is made of an elastic material and has an outside surface providing I(S) of 0.5–10.0, wherein I(S) is given by the following equations:

$$I(S) = \left(\frac{1}{N}\right)\sum_{n=0}^{N-1}\left\{S\left(\frac{n}{N\cdot\Delta t}\right)\right\}$$

$$S\left(\frac{n}{N\cdot\Delta t}\right) = \frac{1}{N}\cdot\left|X\left(\frac{n}{N\cdot\Delta t}\right)\right|^2$$

$$X\left(\frac{n}{N\cdot\Delta t}\right) = \sum_{m=0}^{N-1} x(m\cdot\Delta t)\exp\left(-i2\pi\cdot\frac{n}{N\cdot\Delta t}\cdot m\cdot\Delta t\right)$$

wherein

N is a number of samples obtained from a sectional curve of the outside surface of the guide and is $2^p$ where p is an integer, Δt is a sampling interval, in μm, at which the N-number of the samples are sampled in the longitudinal direction of the guide, the sectional curve being obtained by measuring a profile of the outside surface of the guide through a preset length N·Δt, x(t) is a height of the sectional curve, in μm, of a sample at a position t in the preset length, and n and m are integers.

In a further aspect, the present invention provides an endless belt comprising an endless body having opposite side edges and an interior surface, and a pair of spaced apart parallel guides fixedly secured to the interior surface of said endless body at positions adjacent to said side edges thereof and extending longitudinally along said side edges, wherein each of said guides is made of an elastic material and has an outside surface having Rz' of 2–20 μm, wherein Rz' is an average surface roughness at ten points of a sectional curve obtained by measuring a profile of the outside surface of said guide in the longitudinal direction of said guide.

The present invention also provides an endless belt and roller structure comprising a plurality of rollers, and one of the above-described endless belts supported by the rollers, so that by rotation of the rollers, the endless belt runs in the longitudinal direction of the guides with a side surface of at least one of the guides being in contact with a side surface of at least one of said rollers.

The present invention further provides an image forming apparatus comprising the above endless belt and roller structure.

It has also been found that the lateral movement of the endless belt may be prevented by controlling surface conditions of the outside surfaces of the guides, even though the outside surface of each of the guides are not brought into contact with the drive and other rollers by which the endless belt is supported. It is the side wall of at least one of the guides that is brought into contact with a side end surface of at least one of the rollers, especially at least one of drive rollers. It has been found that a large compressive stress is applied to the guides at their outer surface regions, when the guides are passed through and flexed by drive and other rollers. It has also been found that such a stress may be reduced by controlling surface conditions of the outside surfaces of the guides.

It has been found that a power spectrum obtained by discrete Fourier transformation of a sectional curve of an outside surface of a guide which is not brought into contact with rollers represent powers of waves constituting the sectional curve and that it is a total of the powers of all of these waves that properly represent the surface conditions of the guide that reduce mechanical stress applied to the guide upon flexed by drive an other rollers.

BRIEF DESCRIPTION OF THE DRAWINGS

Other objects, features and advantages of the present invention will become apparent from the detailed description of the preferred embodiments of the invention which follows, when considered in the light of the accompanying drawings, in which.

DETAILED DESCRIPTION OF THE PREFERRED EMBODIMENTS OF THE INVENTION

Figure 1:
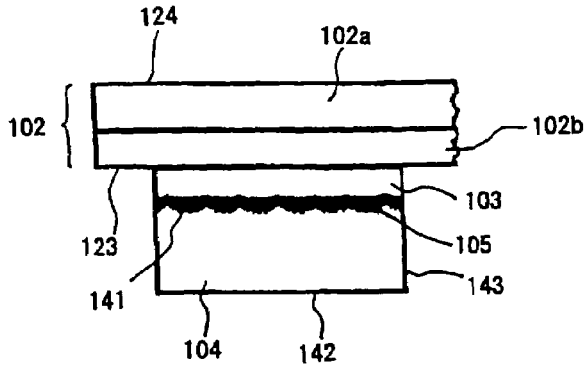
FIG. 1 is a sectional view schematically illustrating one embodiment of an endless tape photoconductor according to the present invention.
Figure 2:
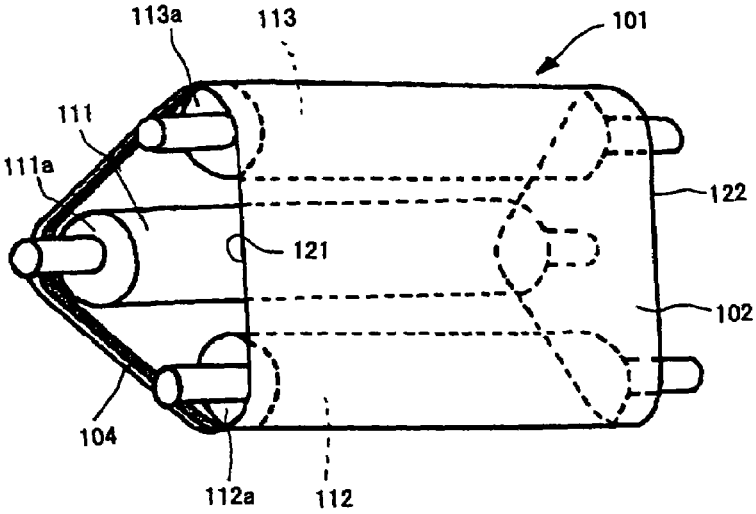
FIG. 2 is a perspective view schematically illustrating one embodiment of an endless tape and roller structure according to the present invention.

Referring to FIG. 1 and FIG. 2, designated generally as 101 is an endless belt according to a first embodiment of the present invention. The endless belt 101 comprises an endless body 102 having opposite side edges 121 and 122, an interior surface 123 and an exterior surface 124. A pair of spaced apart parallel guides 104 are bonded through an adhesive layer 103 to the interior surface 123 of the endless body 102 at positions adjacent to the side edges 121 and 122 (only one guide is shown in FIG. 2) thereof. The guides 104 extend longitudinally along the side edges 121 and 122. Each of the guides 104 is made of an elastic material and has an inside surface 141 which constitutes an interface between the guide 104 and the adhesive layer 103, an outside surface 142 opposite the inside surface 141, and a side surface 143 extending between the inside and outside surfaces 141 and 142. The endless body 102 in the embodiment shown in FIG. 1 comprises a conductive support 102*b* and a photoconductive layer 102*a* provided on the support 102*b*. Since the two guides 104 have a similar construction, the following description will be made of only one of the guides 104.

The inside surface 141 of the guide 104 has such surface characteristics as to provide I(S) of 0.5–13.0, wherein I(S) is obtained by discrete Fourier transformation of a data group of heights x(t) [μm] of a sectional curve of the inside surface 141 of the guide 104 obtained by measuring a profile of the surface through a preset length.

Figure 5:
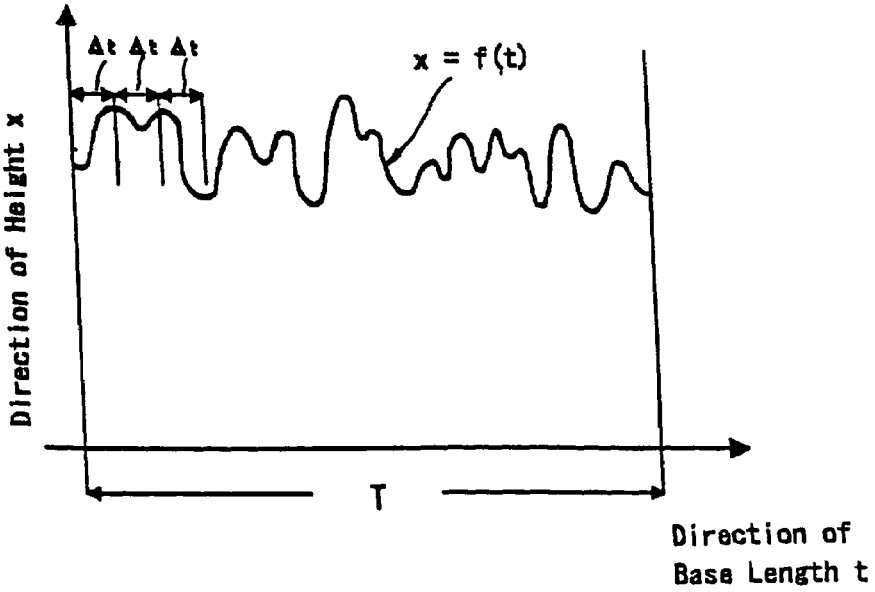
FIG. 5 is a schematic illustration of a sectional curve of a surface of a guide.

As shown in FIG. 5, the data group is obtained by sampling N-number of samples of the sectional curve in a length T at a sampling interval of Δt [μm] in a direction of the base length t of the sectional curve. The base length t extends along the x-axis direction, while the direction of height x(t) of the sectional curve is in parallel with the y-axis. The height t(x) of the sectional curve is a relative amount with reference to an arbitrary base such as a height at the initial point at the start of the measurement or a height at the midpoint (T/2) of the sampling length T. The direction of the base length is a direction of an intersection between a plane of the surface to be measured and a plane in which the surface is cut for obtaining the sectional curve of the surface.

The discrete Fourier transformation is in accordance with the following formula:

$$X\left(\frac{n}{N\cdot\Delta t}\right)=\sum_{m=0}^{N-1}x(m\cdot\Delta t)\exp\left(-i2\pi\cdot\frac{n}{N\cdot\Delta t}\cdot m\cdot\Delta t\right)$$

wherein n and m are integers and $N=2^p$, p is an integer. I(S) is given by the following equations:

$$I(S)=\left(\frac{1}{N}\right)\sum_{n=0}^{N-1}\left\{S\left(\frac{n}{N\cdot\Delta t}\right)\right\}$$

$$S\left(\frac{n}{N\cdot\Delta t}\right)=\frac{1}{N}\cdot\left|X\left(\frac{n}{N\cdot\Delta t}\right)\right|^2$$

When I(S), which relates a total energy of variation in a power spectrum of the sectional curve, is 0.5–13.0, the surface area of the surface 41 of the guide 104 is high so that the adhesion of the guide to the endless body 102 is high. The adhesion is further improved by an anchor effect. Therefore, even when the endless belt 101 is driven at a high running speed, e.g. at a linear velocity of 80 mm/sec or more, a lateral movement of the belt 101 can be effectively prevented. When the I(S) is less than 0.5, the adhesion of the guide 104 to the endless body 102 through the adhesive layer 103 is so weak that a lateral movement of the belt 101 is apt to occur especially when the endless belt 101 is driven at a high running speed. On the other hand, too large I(S) in excess of 13.0 also causes such a lateral movement, because the adhesion between the adhesive layer 103 and the endless body 102 is reduced though the adhesion between the adhesive layer 103 and the guide 104 is very high. I(s) is preferably 0.7–12.0, more preferably 0.9–11.0.

As a method of measuring a sectional curve of a surface of the guide 104 in the present invention, any conventional method such as an optical method, an electrical method, an electrochemical method and a physical method can be employed as long as it has high reproducibility, measurement accuracy and simplicity. Among those, an optical method or a physical method is preferred because of its simplicity, and especially, an optical method or a physical method using a stylus or tracer is most preferred because of its high reproducibility and accuracy.

The sampling is generally conducted in a direction parallel with the longitudinal direction of the guide 104, namely along the running direction of the belt 101.

When the base length of the sectional curve of the surface 141 of the guide 104 is designated as t [μm], the height (amplitude) x(t) [μm] of the curve is an irregular fluctuation quantity. Any irregular fluctuation can be obtained by combining sinusoidal fluctuations with various frequencies with proper phase and amplitude. Namely, it can be expressed by Fourier transform.

$$x(t)=\int_{-\infty}^{\infty}X(k)\exp(i2\pi kt)dk$$

$$X(k)=\int_{-\infty}^{\infty}x(t)\exp(i2\pi kt)dt$$

wherein k is a wave number [$\mu m^{-1}$; the number of waves per μm]. A Fourier component X(k) represents a wave number k [namely, an amplitude of a wave with a wave length $\lambda=1/k$

[μm]] included in the irregular fluctuation quantity x(t). $|X(k)|^2$ represents energy of a component wave with a wave number k.

Consideration will be next made of distribution relation (spectrum) between the wave number k and the energy $|X(k)|^2$ of a component wave having the wave number k. S(k) is an average energy of the component wave having a wave number k of a sectional curve per unit section [1 μm], and defined as a power spectrum.

$$S(k) = \lim_{T\to\infty}\left[\frac{1}{T}|X(k)|^2\right]$$

In practice, however, the height x(t) of the sectional curve cannot be defined in a region of $-\infty<t<\infty$ but the measurement thereof is conducted in a part of a sectional curve, namely in a region of $-T/2\leqq t\leqq T/2$, wherein T is a length of the measured section. Thus, when the S(k) is calculated not by taking the limit as $T\to\infty$ but from the equation:

$$S(k) = \frac{1}{T}|X(k)|^2$$

using a T which is sufficiently large to such an extent that an average with respect to a wavelength of 1/k has a meaning as a microscope physical quantity, the result is substantially the same as the value obtained by taking the limit as $T\to\infty$ As the Fourier transform employed herein is a discrete Fourier transform, the following alternation is conducted.

$$X\left(\frac{n}{N\cdot\Delta t}\right) = \sum_{m=0}^{N-1} x(m\cdot\Delta t)\exp\left(-i2\pi\cdot\frac{n}{N\cdot\Delta t}\cdot m\cdot\Delta t\right)$$

wherein n and m are integers, N is the number of sampled points and represented by $N=2^p$, and Δt [μm] is a sampling interval and has a relation represented by T/Δt=N.)

When the measuring length T of the sectional curve is excessively short, the number of waves involved in the transform is so small that the error may be large or waves to be existed may fail to be evaluated. The measuring range T can be properly determined according to the values of Δt and N. In the case of the present invention, Δt is generally 0.1 to 20.0 μm, preferably 0.2 to 17.0 μm, more preferably 0.3 to 15.0 μm. The smaller Δt is, the more accurately the sectional curve can be reproduced. However, when Δt is less than 0.1 μm, a huge number of sampling points are necessary to make the measuring region T sufficiently large so that all the waves consisting of the sectional curve may be sampled. This increases the burden of calculation and results in decrease of the measuring range T. An amount of Δt of not greater than 20 μm is desired for reasons of extraction of a large number of waves that are concerned with the surface characteristics of the photoconductor.

The more the sampling number N, the better, if the burden of calculation is not taken into consideration. Practically, it is at least 2048, preferably at least 4096, more preferably at least 8192 in order to decrease the error.

Specifically, the calculation of a power spectrum using the discrete Fourier transform is carried out with the following equation:

$$S\left(\frac{n}{N\cdot\Delta t}\right) = \frac{1}{N}\cdot\left|X\left(\frac{n}{N\cdot\Delta t}\right)\right|^2$$

An integral value represented by:

$$\sum_{n=0}^{N-1}\left\{S\left(\frac{n}{N\cdot\Delta t}\right)\right\}$$

represents a total energy of the measured sectional curve. However, the value varies depending upon measurement conditions. Thus, I(S) standardized by N can be employed as a universal parameter. Namely, I(S) can be calculated from the equation:

$$I(S) = \left(\frac{1}{N}\right)\sum_{n=0}^{N-1}\left\{S\left(\frac{n}{N\cdot\Delta t}\right)\right\}$$

The I(S) thus obtained is extremely suited as a parameter for evaluating the surface conditions of the guide 104.

Methods for controlling the surface condition of the guide to I(S) of 0.3–13.0 include mechanically or chemically processing the surface of the guide 104 or a precursor thereof, molding the guide or a precursor thereof in a mold having an interior wall provided with suitable roughness, incorporating a filler in the guide or a precursor thereof, or a combination of these methods. The precursor is cured after the surface thereof has been imparted with the predetermined roughness. Above all, a mechanical processing method such as processing with an abrasive, an abrasive paper (tape), a grinder (a buffing machine or a sand blast) or a method in which a filler such as calcium silicate, carbon, calcium carbonate or a glass fiber is incorporated into the guide is preferably employed.

The incorporation of a filler is especially preferred because not only the surface conditions can be controlled but also the mechanical properties of the guide such as rubber hardness, 300% modulus and structural strengths may be improved. As the filler, the use of carbon or carbonaceous materials such as carbon black is preferred since the frictional force between the guide and the drive rollers is reduced by the lubricating effect of the carbon so that the force applied from the rollers to the guide is reduced. Such a reduction contributes to the prevention of a lateral movement of the running endless belt. The filler generally have a diameter of 0.05 to 10 μm, preferably 0.1 to 8 μm, more preferably 0.3 to 5 μm. The amount of the filler is generally 1–50% by weight, preferably 3–40% by weight, more preferably 5–30% by weight, based on the total weight of the guide 104.

The guide 104 is made of an elastic material such as a synthetic rubber, a natural rubber or a mixture thereof. Examples of the synthetic rubber include polyurethane rubber, neoprene rubber, urethane rubber, chloroprene rubber, nitrile rubber, butyl rubber and silicone rubber. The use of urethane rubber is especially preferred for reasons of stability in a hot, cool or humid environment, resistance to abrasion and resistance to ozone.

The guide 104 preferably has a rubber hardness (JISA) of 50–90, more preferably 55–85, most preferably 60–80, for reasons of prevention of excess deformation and excess repulsive force of the guide during engagement with the rolls while ensuring desired flexibility.

The adhesive layer 3 through which the guide 104 and the endless body 2 are bonded generally has a thickness of 5–100 μm, preferably 10–80 μm, more preferably 20–70 μm, for reasons of ensuring desired adhesion strength and resistance to stresses applied thereto during running of the endless belt 101. Any adhesive agent may be used for forming the adhesion layer 3 as long as desired adhesion is obtained between the guide 104 and the endless body 102, and the adhesive layer 103 has a desired service life. Illustrative of suitable adhesive agents are acrylic resin-based adhesives, natural rubber-based adhesives, synthetic rubber-based adhesives, silicone resin-based adhesives and thermoplastic adhesives. For reasons of high adhesion strength, the use of acrylic resin-based adhesives is particularly preferred. If desired, a primer layer 105 may be interposed between the guide 104 and the adhesive layer 103 to improve the adhesion therebetween. The primer 105 applied to the guide 104 may be, for example, a curable urethane primer.

Figure 3:
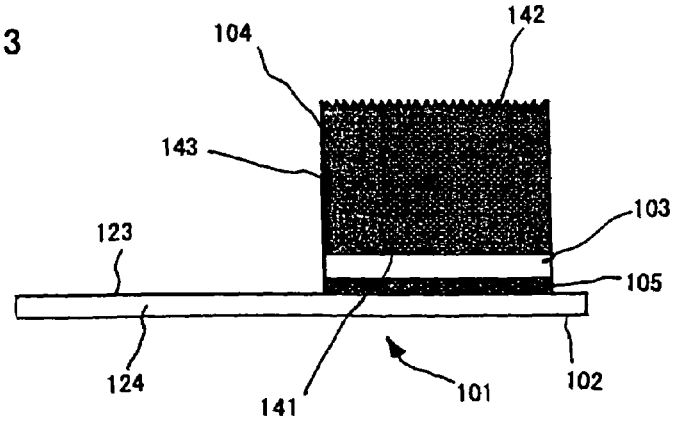
FIG. 3 is a sectional view schematically illustrating another embodiment of an endless tape photoconductor according to the present invention.

FIG. 3 illustrates a second embodiment of an endless belt 101 of the present invention. The endless belt 101 comprises an endless body 102 having interior and exterior surfaces 123 and 124, and a pair of spaced apart parallel guides 104 (only one guide is illustrated) fixedly secured to the interior surface 123 of the endless body 102.

The endless belt 101 of the second embodiment differs from that of the first embodiment only in that each of the guides 104 has an outside surface 142 having specific surface characteristics, while the inside surface 141 has not. Since the two guides 104 have a similar construction, the following description will be made of only one of the guides 104. Thus, as shown in FIG. 2, the endless body 102 has opposite side edges 121 and 122. The guide 104 has an inside surface 141 and a side surface 143 and is made of an elastic material. The guide 4 is fixedly secured to the interior surface 123 of the endless body 102 at a position adjacent to the side edge thereof and extending longitudinally along the side edge.

The outside surface 142 of the guide 104 has I(S) of 0.5–10.0, wherein I(S) is given by the following equations:

$$I(S) = \left(\frac{1}{N}\right)\sum_{n=0}^{N-1}\left\{S\left(\frac{n}{N\cdot\Delta t}\right)\right\}$$

$$S\left(\frac{n}{N\cdot\Delta t}\right) = \frac{1}{N}\cdot\left|X\left(\frac{n}{N\cdot\Delta t}\right)\right|^2$$

$$X\left(\frac{n}{N\cdot\Delta t}\right) = \sum_{m=0}^{N-1} x(m\cdot\Delta t)\exp\left(-i2\pi\cdot\frac{n}{N\cdot\Delta t}\cdot m\cdot\Delta t\right)$$

wherein

N is a number of samples obtained from a sectional curve of the outside surface 142 of the guide and is $2^p$ where p is an integer, Δt is a sampling interval, in μm, at which the N-number of the samples are sampled in the longitudinal direction of the guide 104, the sectional curve being obtained by measuring a profile of the outside surface 142 of the guide 104 through a preset length N·Δt, x(t) is a height of the sectional curve, in μm, of a sample at a position t in the preset length, and n and m are integers.

When I(S) of the outside surface 142, which relates a total energy of variation in a power spectrum of the sectional curve, is less than 0.5, relaxation of the stress applied to an outside region of the guide 104 when flexed by each of the drive and other rollers is not sufficient so that a lateral movement of the belt 101 is apt to occur especially when the endless belt 101 is driven at a high running speed of 80 mm/sec or more. On the other hand, too large I(S) in excess of 10.0 also causes such a lateral movement, because the mechanical strengths of the guide 104 become unsatisfactory. I(s) of the outside surface 142 is preferably 0.6–8.0, more preferably 0.7–6.0.

Although, in the second embodiment, the guide 104 is bonded to the belt 104 through an adhesive layer 103 (and a primer 105), any other bonding such as by melt adhesion or a both-sides adhesive tape may be adopted, if desired. However, bonding by means of an adhesive agent in the same manner as in the first embodiment is desired. In such a case, it is preferred that the inside surface 141 of the guide 104 have I(S) of 0.5–13.0 likewise the first embodiment.

In an endless belt according to a third embodiment of the present invention, the surface characteristics of the inside surface 141 of the first embodiment are modified. Except the surface characteristics of the inside surface 141, the construction of the third embodiment is the same as that of the first embodiment. Thus, referring to FIGS. 1 and 2, the endless belt of the third embodiment comprises an endless body 102 having opposite side edges 121 and 122 and an interior surface 123, and a pair of spaced apart parallel guides 104 (only one guide is illustrated in FIG. 2) bonded through adhesive layers 103 to the interior surface 123 of the endless body 102 at positions adjacent to the side edges 121 and 122 thereof and extending longitudinally along the side edges 121 and 122. Each of the guides 104 is made of an elastic material and has an inside surface 141 which constitutes an interface between the guide 104 and the adhesive layer 103, an outside surface 142 opposite the inside surface 141 and a side surface 143 extending between the inside and outside surfaces 141 and 142. The inside surface 141 has Rz of 3–16 μm, preferably 4–15 μm, more preferably 6–14 μm. Rz is an average surface roughness at ten points of a sectional curve obtained by measuring a profile of the inside surface 141 of the guide 104 in the longitudinal direction of the guide 104. The average surface roughness at ten points Rz is in accordance with Japanese Industrial Standard JIS B0601.

When the Rz is less than 3 μm, the adhesion of the guide 104 to the endless body 102 through the adhesive layer 103 is so weak that a lateral movement of the belt 101 is apt to occur especially when the endless belt 101 is driven at a high running speed. On the other hand, too large Rz in excess of 16 μm also causes such a lateral movement, because the adhesion between the adhesive layer 103 and the endless body 102 is reduced though the adhesion between the adhesive layer 103 and the guide 104 is very high. The first embodiment is more preferred as compared with the third embodiment for reasons of higher reliability and validity.

In an endless belt according to a fourth embodiment of the present invention, the surface characteristics of the outside surface 142 of the second embodiment are modified. Except the surface characteristics of the outside surface 142, the construction of the fourth embodiment is the same as that of the second embodiment. Thus, referring to FIGS. 2 and 3, the endless belt of the third embodiment comprises an endless body 102 having opposite side edges 121 and 122 and an interior surface 123, and a pair of spaced apart parallel guides 104 (only one guide is illustrated in FIG. 2) bonded through adhesive layers 103 to the interior surface 123 of the endless body 102 at positions adjacent to the side edges 121 and 122 thereof and extending longitudinally along the side edges 121 and 122. Each of the guides 104 is made of an elastic material and has an inside surface 141 which constitutes an interface between the guide 104 and the adhesive layer 103, an outside surface 142 opposite the inside surface 141 and a side surface 143 extending between the inside and outside surfaces 141 and 142. The outside surface 142 has Rz' of 2–20 μm, preferably 3–17 μm, more preferably 5–15 μm, wherein Rz' is an average surface roughness at ten points of a sectional curve obtained by measuring a profile of the outside surface 142 of the guide 104 in the longitudinal direction of the guide 104. The average surface roughness at ten points Rz' is in accordance with Japanese Industrial Standard JIS B0601.

When Rz' of the outside surface 142, which relates a total energy of variation in a power spectrum of the sectional curve, is less than 2 μm, relaxation of the stress applied to an outside region of the guide 104 when flexed by-each of the drive and other rollers is not sufficient so that a lateral movement of the belt 101 is apt to occur especially when the endless belt 101 is driven at a high running speed of 80 mm/sec or more. On the other hand, too large Rz' in excess of 20 μm also causes such a lateral movement, because the mechanical strengths of the guide 104 become unsatisfactory. The second embodiment is more preferred as compared with the fourth embodiment for reasons of higher reliability and validity.

The endless body 102 used in the above first through fourth embodiments may be obtained by bonding a sheet into an endless form. Alternately, the endless body 102 may be produced by molding. The latter method is preferred because of absence of a seam. A seamless endless body 102 permits any desired portion thereof to be used and has good mechanical properties, thereby ensuring high speed image formation, compactness of an image forming apparatus and high reliability of an endless belt and roller construction.

FIG. 2 depicts one embodiment of an endless belt and roller structure in which the endless belt 101 (according to any one of the first through fourth embodiments) provided with guides 104 at both side edges 121 and 122 thereof is supported by drive rollers 111 and 112 and a tension roller 113. The number of the drive rollers and the tension rolls may be suitably selected according to the intended use of the endless belt roller structure. Part of drive and/or tension rollers may be disposed to contact with the exterior surface of the endless belt. By operation of the drive rollers 111 and 112 by any known means such as an electric motor, the belt 101 is driven to run in the longitudinal direction of the guides 104, with the side surface 143 (FIGS. 1 and 3) of at least one of the guides 104 being in contact with at least one of the side end walls 111*a*, 112*a* and 113*a* of the rollers 111, 112 and 113, preferably at least one of the side end walls 111*a* and 112*a* of the drive rollers 111 and 112. Thus, a lateral movement of the endless belt 101 is prevented by the guides 104. The outside surface 142 (FIGS. 1 and 3) of the guides 104 is maintained in non-contact with the rollers 111, 112 and 113.

The endless belt 101 according to the present invention may be utilized for many applications such as an endless belt photoconductor, an intermediate transfer belt, a fixing belt and a conveyor belt. When the endless belt 101 is used in an image forming apparatus as, for example, an endless belt photoconductor, the linear velocity of the belt 101 is generally at least 80 mm/second, preferably at least 120 mm/second, more preferably at least 150 mm/second, to meet with high speed image formation. Even at such a high running speed, the belt 101 does not cause lateral movement. Therefore, a good quality image having good resolution may be produced.

The endless belt 101 according to the present invention is best suited for application as an endless belt photoconductor. The service life of a photoconductor depends upon the number of repetition of image formation. Therefore, an increase of the surface area of the photoconductor is one of the effective method for improving the service life thereof. Since an endless belt may be freely deformed and accommodated in a relatively small space by using a plurality of rollers in combination, it is possible to increase the surface area of the photoconductor (length of the endless belt photoconductor) without enlarging the apparatus.

As shown in FIG. 1, the endless body 102 of the endless belt photoconductor comprises a support 102*b* and a photoconductive layer 102*a* supported thereon. If desired, an intermediate layer (not shown) may be disposed between the support 102*b* and the photoconductive layer 102*a*. A protective layer (not shown) may be also provided over the photoconductive layer 102*a*, if necessary.

Any electrically conductive material may be used for the support 102*b* as long as it has satisfactory mechanical strengths. Specific examples of such materials include composite sheets having a synthetic resin substrate on which a metal or alloy layer (e.g. aluminum, nickel, chrome, nickel-chrome alloys, copper, silver, gold or platinum) or a metal oxide layer (e.g. tin oxide or indium oxide) is provided, and metal or alloy sheets or foils (e.g. aluminum, aluminum alloy, nickel, chrome, nickel-chrome alloys, copper, silver, gold, platinum or nickel stainless steel). Especially preferred is a nickel seamless belt disclosed in, for example, Japanese Laid-Open Patent Publication No. S52-36016, No. H03-219259, S63-127250 and S63-127249.

It is preferred that the nickel seamless belt have a Vickers hardness of 400–650, more preferably 450–600, and a nickel content of at least 98%, more preferably at least 99%, for reasons of good durability, deformability, elasticity and mechanical properties.

An intermediate layer (or an undercoat layer) may be provided between the support 102*b* and the photoconductive layer 102*a* for the purpose of improving the adhesion between the support 102*b* and the photoconductive layer 102*a*, preventing interference fringes such as moire, improving applicability of the photoconductive layer on the support and reducing a residual electric potential.

The intermediate layer comprises a resin as the main component. Since the photoconductive layer is provided on the intermediate layer by a coating method using a solvent, it is desirable that the resin for use in the intermediate layer have high resistance against general-purpose organic solvents. Preferable examples of the resin for use in the intermediate layer include water-soluble resins such as polyvinyl alcohol, casein and sodium polyacrylate; alcohol-soluble resins such as copolymer nylon and methoxymethylated nylon; and hardenable resins with three-dimensional network such as polyurethane, melamine resin, phenolic resin, alkyd-melamine resin and epoxy resin. The undercoat layer may further comprise finely-divided particles of metallic oxides such as titanium oxide, silica, alumina, zirconium oxide, tin oxide and indium oxide in order to prevent the occurrence of moire and reduce the residual potential. Similar to the previously mentioned photoconductive layer, the intermediate layer can be provided on the electroconductive support by coating method, using an appropriate solvent.

Further, the intermediate layer for use in the present invention may be prepared using a coupling agent such as a silane coupling agent, titanium coupling agent or chromium coupling agent. Furthermore, to prepare the intermediate layer, $Al_2O_3$ may be deposited on the electroconductive support by anodizing process, or an organic material such as poly-para-xylylene (parylene), or an inorganic material such as $SiO_2$, $SnO_2$, $TiO_2$, ITO or $CeO_2$ may be deposited on the electroconductive support by vacuum thin film forming method. It is proper that the thickness of the intermediate layer be 0–5 μm.

The photoconductive layer 102*a* may be a mix type photoconductive layer in which a charge generating material and a charge transporting material are homogeneously dispersed, or a lamination type photoconductive layer in which a charge generating material-containing layer and a charge transporting material-containing layer are superimposed one over the other.

Description will be made of the lamination type photoconductive layer.

The charge generating layer, which is adapted to generate charges upon being exposed to light, contains a charge generating material as an essential ingredient and, if necessary, a binder resin. Suitable charge generating materials include inorganic materials and organic materials. Specific examples of inorganic charge generating materials include crystalline selenium, amorphous selenium, selenium-tellurium, selenium-tellurium-halogen, selenium-arsenic compounds, amorphous silicon and the like.

Specific examples of the organic charge generating materials include phthalocyanine pigments such as metal phthalocyanine and metal-free phthalocyanine, azulenium pigments, squaric acid methine pigments, azo pigments including a carbazole skeleton, azo pigments including a triphenylamine skeleton, azo pigments including a diphenylamine skeleton, azo pigments including a dibenzothiophene skeleton, azo pigments including a fluorenone skeleton, azo pigments including an oxadiazole skeleton, azo pigments including a bisstilbene skeleton, azo pigments including a distyryloxadiazole skeleton, azo pigments including a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments and bisbenzimidazole. These charge generating materials can be used alone or in combination.

Suitable binder resins, which are optionally used in the charge generating layer, include polyamide resins, poly urethane resins, epoxy resins, polyketone resins, polycarbonate resins, polyarylate resins, silicone resins, acrylic resins, polyvinyl butyral resins, polyvinyl formal resins, polyvinyl ketone resins, polystyrene resins, poly-N-vinylcarbazole resins and polyacrylamide resins. These binder resins may be used alone or in combination. A charge transporting polymer material may be used as a binder resin in the charge generating layer. If desired, a low molecular weight charge transporting material can also be added in the charge generating layer.

The charge generating layer may be prepared by a thin film forming method in a vacuum and a casting method using a solution or dispersion. Specific examples of such thin film forming methods in a vacuum include vacuum evaporation methods, glow discharge decomposition methods, ion plating methods, sputtering methods, reaction sputtering methods and CVD (chemical vapor deposition) methods. Both inorganic and organic charge generation materials may be used as raw materials.

The coating method may include mixing one or more inorganic or organic charge generating materials mentioned above with a solvent such as tetrahydrofuran, cyclohexanone, dioxane, dichloroethane or butanone, and if necessary, together with a binder resin and an additives with a ball mill, an attritor or a sand mill to obtain a dispersion. The dispersion is diluted and applied to a surface to be coated by a dip coating method, a spray coating method, a bead coating method or a ring coating method, followed by drying, thereby to form a charge generating layer.

The thickness of the charge generating layer 122 is preferably from about 0.01 to about 5 μm, more preferably from about 0.05 to about 2 μm.

Next, the charge transporting layer is explained. The charge transporting layer has the function of retaining static charge, transporting charges generated by light exposure and subsequently separated in the layer, and combining the retained electric charges with the charges generated in the charge generation layer. It is desirable for the charge transporting layer to have a high electric resistivity for retaining electric charges, and a small dielectric constant and large charge mobility for attaining high surface potential by the retained electric charges. The charge transporting layer contains a charge transport material and, if necessary, a binder resin. The charge transporting layer can be formed by dissolving or dispersing these components in an appropriate solvent to prepare a coating composition, then coating and drying the composition.

The solvent may be, for example, tetrahydrofuran, dioxane, toluene, dichloromethane, monochlorobenzene, dichloroethane, cyclohexane, methyl ethyl ketone or acetone. If necessary, an additive such as a plasticizer, an adsorbing agent, an antioxidizing agent or a leveling agent may be added to the charge transporting layer.

There are generally two kinds of charge transporting materials, positive-hole transporting materials and electron transporting materials.

Specific examples of such electron transporting materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one and 1,3,7-trinitrobenzothiophene-5,5-dioxide. These electron transporting materials can be used alone or in combination.

Specific examples of positive hole transporting materials include electron donating materials such as oxazole derivatives, oxadiazole derivatives, imidazole derivatives, triphenylamine derivatives, 9-(p-diethylaminostyrylanthracene), 1,1-bis(4-dibenzylaminophenyl)propane, styrylanthracene, styrylpyrazoline, phenylhydrazone compounds, α-phenylstilbene derivatives, thiazole derivatives, triazole derivatives, phenazine derivatives, acridine derivatives, benzofuran derivatives, benzimidazole derivatives and thiophene derivatives. These positive hole transporting materials can be used alone or in combination.

The following known polymers can be used as a charge transporting polymer material:

(A) Polymers having carbazole ring: poly-N-vinylcarbazole, and compounds disclosed in Japanese Laid-Open Patent Applications Nos. 50-82056, 54-9632, 54-11737, 4-175337, 4-183719 and 6-234841.

(B) Polymers having hydrazone structure: compounds disclosed in Japanese Laid-Open Patent Applications Nos. 57-78402, 61-20953, 61-296358, 1-134456, 1-179164, 3-180851, 3-180852, 3-50555, 5-310904 and 6-234840.

(C) Polysilylene compounds: compounds disclosed in Japanese Laid-Open Patent Applications No. 63-285552, 1-88461, 4-264130, 4-264131, 4-264132, 4-264133, and 4-289867.

(D) Polymers having triarylamine structure: N,N-bis(4-methylphenyl)-4-aminopolystyrene, and compounds disclosed in Japanese Laid-Open Patent Applications 1-134457, 2-282264, 2-304456, 4-133065, 4-133066, 5-40350, and 5-202135.

(E) Other polymers: nitropyrene-formaldehyde condensation polymer, and compounds disclosed in Japanese Laid-Open Patent Applications Nos. 51-73888, 56-150749, 6-234836, and 6-234837.

The high-molecular weight charge transport material for use in the charge transporting layer is not limited to the above-mentioned polymers. There can be employed various copolymers, block polymers, graft polymers, and star polymers, each comprising any of the conventional monomers. In addition, crosslinked polymers having an electron donating group, for example, as disclosed in Japanese Laid-Open Patent Application No. 3-109406, are also usable.

Further, in the charge transporting layer, it is advantageous to employ as the high-molecular weight charge transport material a polycarbonate compound having a triarylamine structure, a polyurethane, a polyester, and a polyether, as disclosed in Japanese Laid-Open Patent Applications Nos. 64-1728, 64-13061, 64-19049, 4-11627, 4-225014, 4-230767, 4-320420, 5-232727, 7-56374, 9-127713, 9-222740, 9-265197, 9-211877, and 9-304956.

Examples of the binder resin for use in the charge transporting layer include polycarbonate (bisphenol A type, bisphenol Z type, and bisphenol C type), polyester, methacrylic resin, acrylic resin, polyethylene, vinyl chloride, vinyl acetate, polystyrene, phenolic resin, epoxy resin, polyurethane, poly(vinylidene chloride), alkyl resin, silicone resin, poly(vinylcarbazole), poly(vinyl butyral), poly(vinyl formal), polyacrylate, polyacrylamide and phenoxy resin. Those binder resins may be used alone or in combination. For reasons of preventing formation of cracks in the photoconductive layer, the use of a bisphenol A-type polycarbonate resin is preferred.

The charge transporting layer generally has a thickness of 5–100 μm.

Suitable antioxidants for use in the layers of the endless belt photoconductor include the following compounds, but are not limited thereto.

Monophenol Compounds:

2,6-di-t-butyl-p-cresol, butylated hydroxyanisole, 2,6-di-t-butyl-4-ethylphenol, stearyl-.beta.-(3,5-di-t-butyl-4-hydroxyphenyl)propionate, and the like compounds;

Bisphenol Compounds:

2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), and the like compounds;

High Molecular Phenolic Compounds:

1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like compounds;

Paraphenylenediamine Compounds:

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like compounds;

Hydroquinone Compounds:

2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, and the like compounds;

Organic Sulfur-containing Compounds:

dilauryl-3,3'-thiodipropionate, distearyl-3,3'-thiodipropionate, ditetradecyl-3,3'-thiodipropionate, and the like compounds; and Organic Phosphorus-containing Compounds:

triphenylphosphine, tri(nonylphenyl)phosphine, tri(dinonylphenyl)phosphine, tricresylphosphine, tri(2,4-dibutylphenoxy)phosphine, and the like compounds.

The concentration of the antioxidant in the photosensitive layer is from 0.1 to 100 parts by weight, and preferably from 2 to 30 parts by weight, per 100 parts by weight of the charge transport material included in the photoconductive layer.

Any plasticizer used for general resins, such as dibutyl phthalate or dioctyl phthalate may be added to the charge transport layer coating liquid as it is. In this case, it is proper that the amount of plasticizer be in the range of 0 to about 30 wt % of the total weight of the binder resin for use in the charge transport layer.

As the leveling agent for use in the charge transport layer coating liquid, there can be employed polymers and oligomers having a perfluoroalkyl group on the side chain thereof. The proper amount of leveling agent is in the range of 0 to about 1 wt % of the total weight of the binder resin for use in the charge transport layer.

A protective layer may be provided over the photoconductive layer 102*a*. The protective layer may contain fine particulate of a metal oxide dispersed in a binder resin. Examples of such a binder resin for use in the protective layer include ABS resin, ACS resin, copolymer of olefin and vinyl monomer, chlorinated polyether, allyl, resin, polyacetal, polyamide, polyamideimide, polyacrylate, polyallyl sulfone, polybutyelene, polybutylene terephthalate, polycarbonate, polyether sulfone, polyethylene, poly(ethylene terephthalate), polyimide, acrylic resin, polymethyl pentene, polypropylene, polyphenylene oxide, polysulfone, polystyrene, AS resin, butadiene-styrene copolymer, polyurethane, poly(vinyl chloride) and epoxy resin.

Examples of the metal oxide include titanium oxide, tin oxide, potassium titanate, TiO, TiN, zinc oxide, indium oxide and antimony oxide. For the purpose of improving abrasion resistance of the protective layer, a fluorine-containing resin such as a polytetrafluoro-ethylene resin, a silicone resin or an inorganic powder-dispersed polytetrafluoroethylene resin, an inorganic powder-dispersed silicone resin may be further incorporated into the protective layer. The inorganic powder may be, for example, aluminum oxide powder or titanium oxide powder. The protective layer may be prepared by the conventional coating method. The thickness of the protective layer is generally 0.1–10 μm.

When the endless belt of the present invention is utilized as an intermediate transfer belt for receiving a toner image from an image bearing member such as a photoconductor and transferring the toner image to an image receiving medium such as paper, the endless body may be of a type which has a support, an elastic layer provided on the support and a releasing layer provided on the elastic layer. The support may be a metal or an alloy belt such as aluminum, iron, copper or stainless steel or a synthetic resin belt in which electrically conductive particles such as carbon or metal particles are dispersed. The elastic layer may be made of a resin in which a conductive material is dispersed. The resin may be acrylonitrile-butadiene rubber (NBR), styrene-butadiene rubber, butadiene rubber, ethylene-propylene rubber, chloroprene rubber, chlorosulfonated polyethylene, chlorinated polyethylene, acrylonitrile-butadiene-styrene rubber, acrylic rubbers, fluoro rubbers or urethane rubber. The conductive material dispersed in the elastic layer may be, for example, carbon (e.g. Ketchen Black), graphite, carbon fiber, metal powder, an electrically conductive metal oxide, an organic metal oxide, an organometallic compound or an electrically conductive polymer. The surface release layer may be a fluorine resin such as PFA or FEP.

The endless body for the intermediate transfer belt may also be a polymer substrate into which electrically conductive particles (filler) are dispersed. The conductive particles may be those material mentioned immediately above. Examples of the polymer of the substrate include polyethylene (high density, medium density, low density or linear low density polyethylene),. propylene-ethylene block copolymer, propylene-ethylene random copolymer, ethylene-propylene copolymer rubber, styrene-butadiene rubber, styrene-butadiene-styrene block copolymer, hydrogenated derivatives thereof, polybutadiene, polyisobutylene, polyamide, polyamideimide, polyacetal, polyarylate, polycarbonate, polyphenylene ether, modified polyphenylene ether, polyimide, liquid crystal polyester, polyethylene terephthalate, polysulfone, polyethersulfone, polyphenylene sulfide, polybisamidetriazol, polybutylene terephthalate, polyether imide, polyether ether ketone, polyacrylate, polyvinylidene fluoride, polyvinyl fluoride, ethylene-tetrafluoroethylene copolymer, polychlorotrifluoroethylene, tetrafluoroethylene-hexafluoropropylene copolymer, tetrafluoroethylene-perfluoroalkyl vinyl ether copolymer, polytetrafluoroethylene, fluorine rubber, alkyl acrylate copolymer, polyester-ester copolymer, polyether-ester copolymer, polyether-amide copolymer, olefin copolymer and polyurethane copolymer, and mixtures thereof. Especially preferred are fluorine-containing rubber or resin such as polyvinylidene fluoride, polyvinyl fluoride, ethylene-tetrafluoroethylene copolymer, polychlorotrifluoroethylene, tetrafluoroethylene-hexafluoropropylene copolymer, tetrafluoroethylene-perfluoroalkyl vinyl ether copolymer and polytetrafluoroethylene.

The intermediate transfer belt preferably has a resistivity of $10^6$ to $10^{10}$ Ω·cm at an applied voltage of 1 kV.

In the above-described endless intermediate transfer belt having an elastic layer and a surface releasing layer, the thickness of the elastic layer is preferably 0.5–5 mm for reasons of formation of desired nip, while the thickness of the releasing layer is preferably 50–200 μm for reasons of exhibiting desired releasing properties without adversely affecting the function of the elastic layer provided therebelow.

For the purpose of improving transferability of toner images from the intermediate transfer belt to a receiving medium such as paper, zinc stearate may be applied to a surface of the belt so as to make the friction coefficient of the belt smaller than that of the paper (generally 0.35–0.7). Thus, zinc stearate is preferably applied so that the surface of the belt has a friction coefficient of 0.15–0.3.

The endless belt of the present invention may also be used as a conveyor belt for conveying a receiving medium such as paper through a fixing zone. The endless body for the endless belt may be a conductive belt such as a resin belt in which metal or alloy (e.g. aluminum, iron, copper or stainless steel) or carbon is dispersed or a metal or alloy (e.g. nickel or stainless steel) belt. Paper is electrostatically secured to the belt during passage to prevent displacement, formation of wrinkles and disturbance of the toner image before fixation.

The endless belt according to the present invention can be used as a fixation belt. A heat-resisting resin such as polyimide, polyamide or polyester, or a metal may be used for forming the endless body.

Figure 4:
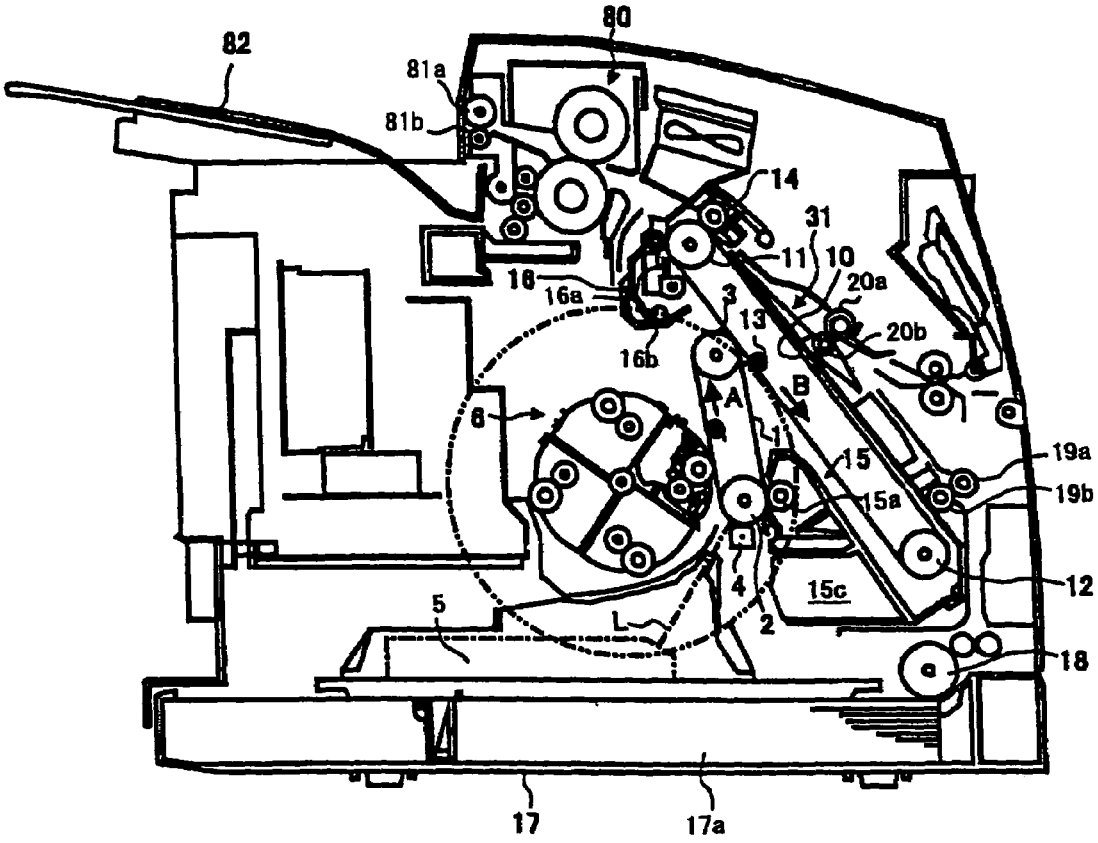
FIG. 4 is a schematic sectional view showing an image forming apparatus according to the present invention.

FIG. 4 depicts one example of an internal construction of a multi-color image forming apparatus using an endless belt according to the present invention. The multi-color image forming apparatus includes a flexible endless belt photoconductor 1 which functions as an electrostatic latent image bearable member. The endless belt photoconductor 1 is spanned around a rotating roller 2 and a rotating roller 3, and is driven to rotate in the direction indicated by the arrow A (i.e., in the clockwise direction) by the rotating roller 2.

Also illustrated in FIG. 4 is a charger 4 serving as a charging device that uniformly charges the surface of the endless belt photoconductor 1. A laser optical device unit 5 serving as an exposing device exposes the surface of the photoconductive belt 1 to form electrostatic latent images thereon. Reference numeral 6 designates a revolver-type multi-color developing apparatus that is integrally formed by four developing devices containing yellow, magenta, cyan, and black developers. An intermediate transfer belt 10 is spanned around a rotating roller 11 and a rotating roller 12, and is driven to run in the direction indicated by arrow B (i.e., in the counterclockwise direction) by the rotating roller 11. The endless belt photoconductor 1 and the intermediate transfer belt 10 contact with each other at the rotating roller 3. A bias roller 13 having electrical conductivity is provided on the contact side of the intermediate transfer belt 10 for contacting with a backside surface of the intermediate transfer belt 10 under a predetermined condition.

The above multi-color image forming apparatus operates as follows. The endless belt photoconductor 1 is first uniformly charged by the charger 4 in a non-contact mode. Subsequently, the endless belt photoconductor 1 is exposed to image information by scanning with the laser optical device 5, so that a latent image is formed on the surface of the endless belt photoconductor 1. The exposed image information is obtained by separating a desired full color image data into respective single color image data including yellow, cyan, magenta, and black. The surface of the endless belt photoconductor 1 is exposed by scanning with a laser beam L emitted from a semiconductor laser (not shown) based on the image information.

The revolver developing apparatus 6 develops the latent image with each predetermined color toner, such as, yellow, cyan, magenta, and black. As a result, each single color toner image is sequentially formed on the endless belt photoconductor 1. Each single color toner image formed on the endless belt photoconductor 1, running in the direction indicated by the arrow A, is sequentially transferred to the intermediate transfer belt 10 synchronously rotating in the direction indicated by the arrow B by a predetermined transfer bias applied by the bias roller 13 in an order of yellow, cyan, magenta, and black. As a result of the transfer, four color toner images are superimposed on each other on the intermediate transfer belt 10. The transfer order is not limited to the above-described order. The length of the intermediate transfer belt 10 is two times as long as that of the endless belt photoconductor 1. The both belts 10 and 1 are strictly controlled so that a predetermined position of the intermediate transfer belt 10 is always brought into contact with a predetermined location of the endless belt photoconductor 1. Although not shown, a stick-like zinc stearate is disposed so that it is applied to a surface of the intermediate transfer belt 10.

The yellow, cyan, magenta, and black toner images superimposed on the intermediate transfer belt 10 are transferred to an image receiving sheet 17*a* at one time by a transfer roller 14. The image receiving sheet 17*a* is fed from a sheet feeding cassette 17 by a sheet feeding roller 18 and conveyed to a transfer section via a pair of transfer rollers 19*a* and 19*b* and a pair of registration rollers 20*a* and 20*b*. After being transferred to the image receiving sheet 17*a*, the color toner image is fixed on the image receiving sheet 17*a* by a fixing device 80. The image receiving sheet 17*a* with full color image is discharged to a sheet stacker unit 82 via a pair of discharging rollers 81*a* and 81*b*.

Referring still to FIG. 4, the multi-color image forming apparatus further includes a waste toner cleaning device 15 having a cleaning blade 15*a* that constantly contacts with the endless belt photoconductor 1 and removes toner thereon. There is provided a cleaning device 16 including a cleaning blade 16*a* that cleans the intermediate transfer belt. 10. The cleaning blade 16*a* is configured to be held in a non-contacting relation to the surface of the intermediate transfer belt 10 during an image forming operation, and to abut the surface of the intermediate transfer belt 10 after the color toner image on the intermediate transfer belt 10 has been transferred to the transfer sheet 17*a*.

The waste toner removed from the intermediate transfer belt 10 by the cleaning blade 16*a* is transferred in a forward direction as seen in FIG. 4 by an auger 16*b* provided in the cleaning device 16. The waste toner is conveyed to a waste toner collecting vessel 15*c* by a transfer section (not shown) which is provided at the front side of a process cartridge 31. The process cartridge 31 is integrally provided with the photoconductive belt 1, the charger 4, the intermediate transfer belt 10, the cleaning devices 15 and 16, and the registration roller 20*b*. The waste toner collecting vessel 15*c* is detachably installed to the process cartridge 31. When the waste toner collecting vessel 15*c* collects more than a predetermined amount of waste toner, the waste toner collecting vessel 15*c* is replaced independently of the process cartridge 31. Because it is not necessary to replace the whole process cartridge 31 when the waste toner collecting vessel 15*c* collects more than the predetermined amount of waster toner, the service life of the process cartridge 31 is extended. The exterior part of the case of the process cartridge 31 at the side of the registration roller 20*b* also serves as a sheet transfer guide member.

The following examples will further illustrate the present invention.

EXAMPLE 1

Preparation of Guide:

One side of a polyurethane rubber sheet having a thickness of 0.7 mm and a rubber hardness of 73.5 was treated with a sander. The thus treated surface of the rubber sheet was measured for a sectional curve using a surface roughness meter (Surfcom 1400A, made by Tokyo Seimitsu K.K.). From the sectional curve, N (=8192) points were sampled at an interval of Δt (=10000/8192) μm in a predetermined direction and subjected to the discrete Fourier transform. Then, the power spectrum was calculated to reveal that I(S) was 7.8. A curable urethane-vinyl chloride copolymer-based primer was applied to the treated surface of the sheet so that the primer layer had a thickness of about 5 μm after drying. An acrylate-based adhesive agent to which 5% by weight of a curing agent had been added was then applied to the primer layer of the sheet and dried at 80–100° C. for 5 minutes to form an adhesive layer having a thickness of about 30 μm. After the adhesive layer had been covered with a releasable paper, the sheet was cut along the above-mentioned predetermined direction using a punch provided with a Thomson blade to obtain guides each having width of 4 mm.

Preparation of Endless Belt Photoconductor:

Using an endless seamless nickel belt having Vickers hardness of 480–510, a purity of 99.2% or more, a peripheral length of 290.3 mm and a thickness of 30 m, an endless belt photoconductor was prepared.

15 Parts by weight of a commercially available alkyd resin (Trademark "Beckolite M6401-50", made by Dainippon Ink & Chemicals, Incorporated) with a solid content of 50 wt. %, and 10 parts by weight of a commercially available melamine resin (Trademark "Super Beckamine L-121-60", made by Dainippon Ink & Chemicals, Incorporated) with a nonvolatile content of 60 wt. % were dissolved in 31.7 parts by weight of methyl ethyl ketone, to which 50 parts by weight of titanium oxide particles (Trademark "CR-60", made by Ishihara Sangyo Kaisha, Ltd.) was added. The resultant mixture was dispersed in a ball mill for 72 hours using alumina balls having a diameter of 10 mm. To the thus milled mixture, 105.0 parts by weight of cyclohexanone was added and the mixture was milled for 2 hours to obtain a coating liquid for an undercoat layer.

The coating liquid was applied by spray coating to an outer surface of the nickel seamless belt and dried at 135° C. for 25 minutes to form an undercoat layer having a thickness of 6.5 μm thereon.

1.0 Part by weight of a butyral resin (S-LEC BLS, made by Sekisui Chemical Co., Ltd.) was dissolved in 80 parts by weight of cyclohexanone. To the solution were added 1.5 parts by weight of a tris-azo pigment having a structure represented by the following structural formula (1) and 1.5 parts by weight of a bis-azo pigment having a structure represented by the following formula (2).

(1)

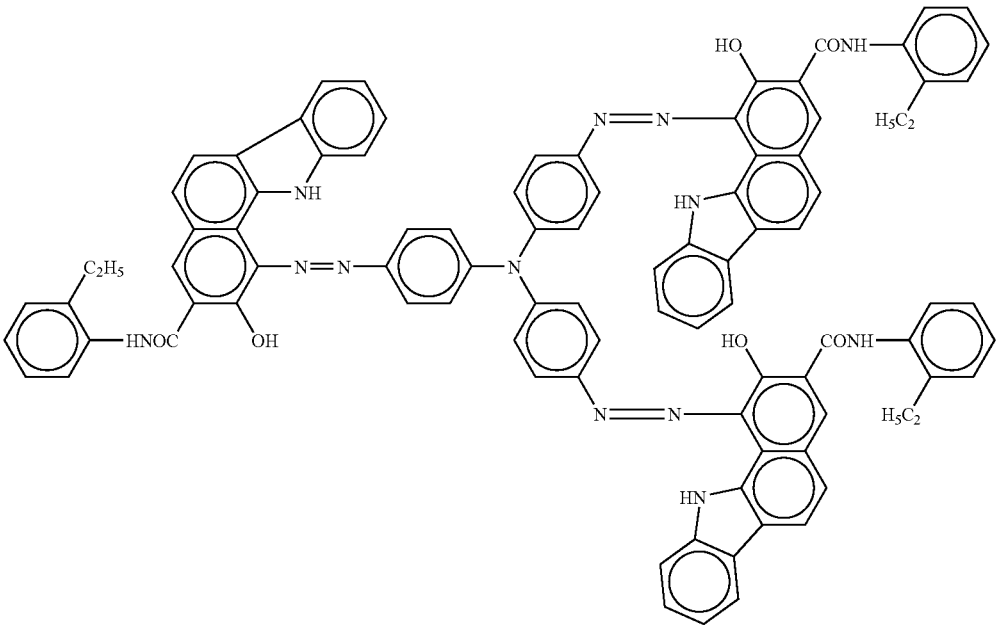

(2)

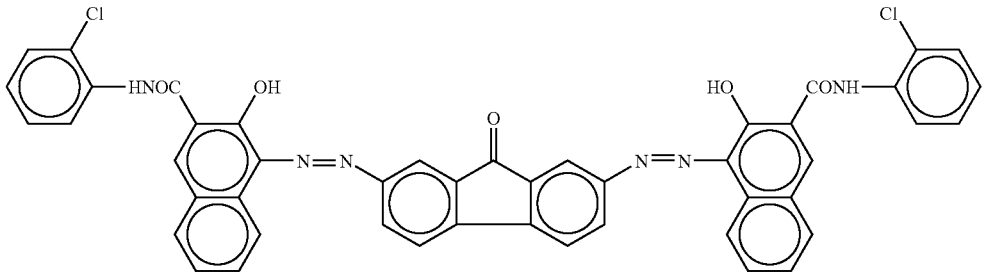

The mixture was milled in a ball mill for 1 hour using alumina balls having a diameter of 10 mm. The milled mixture was diluted with 78.4 parts by weight of cyclohexanone and 237.6 parts by weight of methyl ethyl ketone to a coating liquid for a charge generating layer. The charge generating layer coating liquid was then applied by spray coating to the undercoat layer of the nickel seamless belt and then dried at 130° C. for 20 minutes to form a charge generating layer having a thickness of about 0.12 μm.

7 Parts of a charge transporting material having a structure represented by the following structural formula (3), 10 parts of a polycarbonate resin (C-1400, made by Teijin Chemicals, Ltd.), 0.002 parts of a silicone oil (KF-50, made by Shin-Etsu Chemical Co., Ltd.), 841.5 parts by weight of tetrahydrofuran, 841 parts by weight of cyclohexanone and 0.04 part by weight of 3-t-butyl-4-hydroxyanisol were mixed to obtain a coating liquid for a charge transporting layer.

(2)

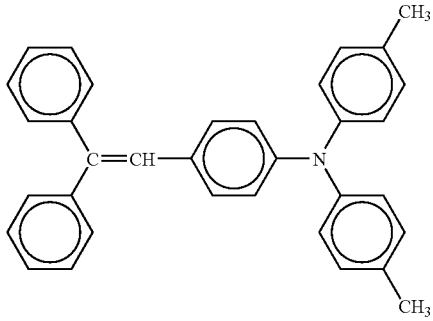

The coating liquid for a charge transporting layer was applied to the above charge generating layer by spray immersion coating and dried at 140° C. for 30 minutes to form a charge transporting layer having a thickness of about 25 μm on the charge generating layer. The thus obtained endless sheet was cut into a width of 367 mm to obtain an endless body having a photoconductive layer on an exterior surface thereof.

Each of the two guides obtained above was obliquely cut at both ends. While removing the releasable paper, the guides were bonded, along the side edges, to an interior peripheral surface of the endless body at positions inwardly spaced apart by 5 mm from respective side edges of the endless body, thereby obtaining an endless belt photoconductor as shown in FIG. 1 in which the adhesive layer of each of the guides was in contact with the interior surface of the endless body. A gap of about 1 mm was defined between the both ends of each of the fixed guides.

Image Formation:

The endless belt photoconductor was incorporated in an image forming machine (IPSIO Color 5000 manufactured by Ricoh Company, Ltd.; resolution of writing image: 600 dpi; linear speed of the endless belt photoconductor: 96 mm/sec). A color image composed of a plurality of color square patterns (1 cm×1 cm) contiguously arranged in a matrix form was reproduced to obtain 30,000 copies. Images of 10th, 2000th, 5000th, 10000th and 30000th copies were evaluated for color printing defects attributed to printed color misregistrations. No color printing defects were found even in the 30000th copy.

EXAMPLE 2

Example 1 was repeated in the same manner as described except that the conditions of the treatment of the polyurethane rubber sheet with the sander were varied so that the treated sheet had I(S) of 8.3. No color printing defects attributed to printed color misregistrations were found even in the 30000th copy.

EXAMPLE 3

Example 1 was repeated in the same manner as described except that the conditions of the treatment of the polyurethane rubber sheet with the sander were varied so that the treated sheet had I(S) of 4.8. No color printing defects attributed to printed color misregistrations were found even in the 30000th copy.

EXAMPLE 4

Example 1 was repeated in the same manner as described except that the image forming machine (IPSIO Color 5000) was modified so that the resolution of writing image was 1200 dpi. No color printing defects attributed to printed color misregistrations were found even in the 30000th copy.

COMPARATIVE EXAMPLE 1

Example 4 was repeated in the same manner as described except that the polyurethane rubber sheet was not treated at all with the sander so that the sheet had I(S) of 0.41. No color printing defects attributed to printed color misregistrations were found even in the 5000th copy. However, color printing defects attributed to printed color misregistrations were observed in the 10000th copy.

EXAMPLE 5

One side of a polyurethane rubber sheet containing 10% by weight of carbon black and having a thickness of 0.7 mm and a rubber hardness of 70.1 was treated with a sander. The surface of the thus treated sheet was measured for a sectional curve using a surface roughness meter (Surfcom 1400A, made by Tokyo Seimitsu K.K.). From the sectional curve, N (=8192) points were sampled at an. interval of Δt (=10000/8192) μm in a predetermined direction and subjected to the discrete Fourier transform. Then, the power spectrum was calculated to reveal that I(S) was 5.0. Using the thus treated rubber sheet, an endless belt photoconductor was prepared in the same manner as that in Example 1. The endless belt photoconductor was tested in the same manner as that in Example 4. No color printing defects attributed to printed color misregistrations were found even in the 30000th copy.

EXAMPLE 6

Example 5 was repeated in the same manner as described except that the conditions of the treatment of the polyurethane rubber sheet with the sander were varied so that the treated sheet had I(S) of 11.7. No color printing defects attributed to printed color misregistrations were found even in the 30000th copy.

EXAMPLE 7

One side of a polyurethane rubber sheet containing 5% by weight of carbon black and having a thickness of 0.7 mm and a rubber hardness of 57.3 was treated with a sander. The surface of the thus treated sheet was measured for a sectional curve using a surface roughness meter (Surfcom 1400A, made by Tokyo Seimitsu K.K.). From the sectional curve, N (=8192) points were sampled at an interval of Δt (=10000/8192) μm in a predetermined direction and subjected to the discrete Fourier transform. Then, the power spectrum was calculated to reveal that I(S) was 0.55. Using the thus treated rubber sheet, an endless belt photoconductor was prepared in the same manner as that in Example 1. The endless belt photoconductor was tested in the same manner as that in Example 4. No color printing defects attributed to printed color misregistrations were found in the 2000th copy.

EXAMPLE 8

Example 6 was repeated in the same manner as described except that the image forming machine (IPSIO Color 5000) was modified so that the running speed of the endless belt photoconductor was increased to 160 mm/sec. No color printing defects attributed to printed color misregistrations were found even in the 30000th copy.

COMPARATIVE EXAMPLE 2

One side of a polyurethane rubber sheet having a thickness of 0.7 mm and a rubber hardness of 96.6 was treated with a sander. The surface of the thus treated sheet was measured for a sectional curve using a surface roughness meter (Surfcom 1400A, made by Tokyo Seimitsu K.K.). From the sectional curve, N (=8192) points were sampled at an interval of Δt (=10000/8192) μm in a predetermined direction and subjected to the discrete Fourier transform. Then, the power spectrum was calculated to reveal that I(S) was 15.2. The surface of the treated sheet was further measured for average roughness Ra to reveal that Ra was 4.6 μm. Using the thus treated rubber sheet, an endless belt photoconductor was prepared in the same manner as that in Example 1. The endless belt photoconductor was tested in the same manner as that in Example 4. Color printing defects attributed to printed color misregistrations began occurring in the 10th copy. In the 91st copying operation, the endless belt disengaged from the drive rollers so that further operation was not able to continue.

EXAMPLE 9

One side of a polyurethane rubber sheet having a thickness of 0.7 mm and a rubber hardness of 67.1 was treated with a sander. The surface of the thus treated sheet was measured for a sectional curve using a surface roughness meter (Surfcom 1400A, made by Tokyo Seimitsu K.K.). From the sectional curve, N (=8192) points were sampled at an interval of Δt (=10000/8192) μm in a predetermined direction and subjected to the discrete Fourier transform. Then, the power spectrum was calculated to reveal that I(S) was 1.9. The surface of the treated sheet was further measured for average roughness Ra to reveal that Ra was 0.4 μm. Using the thus treated rubber sheet, an endless belt photoconductor was prepared in the same manner as that in Example 1. The endless belt photoconductor was tested in the same manner as that in Example 4. No color printing defects attributed to printed color misregistrations were found even in the 30000th copy.

COMPARATIVE EXAMPLE 3

Example 9 was repeated in the same manner as described except that the polyurethane rubber sheet was not treated at all with the sander so that the sheet had I(S) of 0.4. The average roughness was measured to give Ra of 0.4 μm Color printing defects attributed to printed color misregistrations were observed in the 30000th copy.

EXAMPLE 10

Preparation of Guide:

One side of a polyurethane rubber sheet having a thickness of 0.7 mm and a rubber hardness of 70.9 was treated with a sander. The thus treated surface of the rubber sheet was measured for a sectional curve using a surface roughness meter (Surfcom 1400A, made by Tokyo Seimitsu K.K.). From the sectional curve, N (=8192) points were sampled at an interval of at (=10000/8192) μm in a predetermined direction and subjected to the discrete Fourier transform. Then, the power spectrum was calculated to reveal that I(S) was 1.73. A curable urethane-vinyl chloride copolymer-based primer was applied to the non-treated surface of the sheet so that the primer layer had a thickness of about 5 μm after drying. An acrylate-based adhesive agent to which 5% by weight of a curing agent had been added was then applied to the primer layer of the sheet and dried at 80–100° C. for 5 minutes to form an adhesive layer having a thickness of about 30 μm. After the adhesive layer had been covered with a releasable paper, the sheet was cut along the above-mentioned predetermined direction using a punch provided with a Thomson blade to obtain guides each having width of 4 mm.

Preparation of Endless Belt Photoconductor:

Using the thus obtained guides, an endless belt photoconductor as shown in FIG. 3 was prepared in the same manner as that in Example 1 except that except that the charge transporting material having a structure represented by the structural formula (3) was replaced by a charge transporting material having a structure represented by the following structural formula (4):

(4)

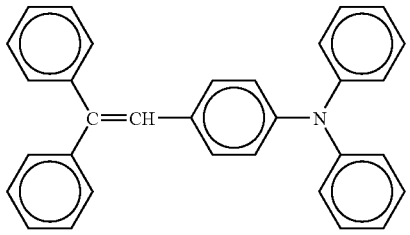

Image Formation:

The endless belt photoconductor was tested for color printing defects attributed to printed color misregistrations in the same manner as described in Example 1. No color printing defects were found even in the 30000th copy.

EXAMPLE 11

Example 10 was repeated in the same manner as described except that the conditions of the treatment of the polyurethane rubber sheet with the sander were varied so that the treated sheet had I(S) of 3.1. No color printing defects attributed to printed color misregistrations were found even in the 30000th copy.

EXAMPLE 12

Example 10 was repeated in the same manner as described except that the conditions of the treatment of the polyurethane rubber sheet with the sander were varied so that the treated sheet had I(S) of 1.39. No color printing defects attributed to printed color misregistrations were found even in the 30000th copy.

EXAMPLE 13

Example 10 was repeated in the same manner as described except that the image forming machine (IPSIO Color 5000) was modified so that the resolution of writing image was 1200 dpi. No color printing defects attributed to printed color misregistrations were found even in the 30000th copy.

COMPARATIVE EXAMPLE 4

Example 13 was repeated in the same manner as described except that the polyurethane rubber sheet was not treated at all with the sander so that the sheet had I(S) of 0.41. No color-printing defects attributed to printed color misregistrations were found even in the 5000th copy. However, color printing defects attributed to printed color misregistrations were observed in the 10000th copy.

EXAMPLE 14

One side of a polyurethane rubber sheet containing 10% by weight of carbon black and having a thickness of 0.7 mm and a rubber hardness of 70.0 was treated with a sander. The surface of the thus treated sheet was measured for a sectional curve using a surface roughness meter (Surfcom 1400A, made by Tokyo Seimitsu K.K.). From the sectional curve, N (=8192) points were sampled at an interval of Δt (=5000/8192) μm in a predetermined direction and subjected to the discrete Fourier transform. Then, the power spectrum was calculated to reveal that I(S) was 2.09. Using the thus treated rubber sheet, an endless belt photoconductor was prepared in the same manner as that in Example 10. The endless belt photoconductor was tested in the same manner as that in Example 13. No color printing defects attributed to printed color misregistrations were found even in the 30000th copy.

EXAMPLE 15

Example 14 was repeated in the same manner as described except that the conditions of the treatment of the polyurethane rubber sheet with the sander were varied so that the treated sheet had I(S) of 4.22. No color printing defects attributed to printed color misregistrations were found even in the 30000th copy.

EXAMPLE 16

One side of a polyurethane rubber sheet containing 5% by weight of carbon black and having a thickness of 0.7 mm and a rubber hardness of 55.9 was treated with a sander. The surface of the thus treated sheet was measured for a sectional curve using a surface roughness meter (Surfcom 1400A, made by Tokyo Seimitsu K.K.). From the sectional curve, N (=8192) points were sampled at an interval of Δt (=5000/8192) μm in a predetermined direction and subjected to the discrete Fourier transform. Then, the power spectrum was calculated to reveal that I(S) was 0.91. Using the thus treated rubber sheet, an endless belt photoconductor was prepared in the same manner as that in Example 10. The endless belt photoconductor was tested in the same manner as that in Example 13. No color printing defects attributed to printed color misregistrations were found in the 2000th copy.

EXAMPLE 17

Example 15 was repeated in the same manner as described except that the image forming machine (IPSIO Color 5000) was modified so that the running speed of the endless belt photoconductor was increased to 160 mm/sec. No color printing defects-attributed to printed color misregistrations were found even in the 30000th copy.

COMPARATIVE EXAMPLE 5

One side of a polyurethane rubber sheet containing 13% by weight of carbon black and having a thickness of 0.7 mm and a rubber hardness of 97.7 was treated with a sander. The surface of the thus treated sheet was measured for a sectional curve using a surface roughness meter (Surfcom 1400A, made by Tokyo Seimitsu K.K.). From the sectional curve, N (=8192) points were sampled at an interval of Δt (=5000/8192) μm in a predetermined direction and subjected to the discrete Fourier transform. Then, the power spectrum was calculated to reveal that I(S) was 11.49. The surface of the treated sheet was further measured for average roughness Ra to reveal that Ra was 4.0 μm. Color printing defects attributed to printed color misregistrations began occurring in the 8th copy. In the 47th copying operation, the endless belt disengaged from the drive rollers so that further operation was not able to continue.

EXAMPLE 18

One side of a polyurethane rubber sheet having a thickness of 0.7 mm and a rubber hardness of 68.0 was treated with a sander. The surface of the thus treated sheet was measured for a sectional curve using a surface roughness meter (Surfcom 1400A, made by Tokyo Seimitsu K.K.). From the sectional curve, N (=8192) points were sampled at an interval of Δt (=10000/8192) μm in a predetermined direction and subjected to the discrete Fourier transform. Then, the power spectrum was calculated to reveal that I(S) was 1.94. The surface of the treated sheet was further measured for average roughness Ra to reveal that Ra was 0.4 μm. Using the thus treated rubber sheet, an endless belt photoconductor was prepared in the same manner as that in Example 10. The endless belt photoconductor was tested in the same manner as that in Example 13. No color printing defects attributed to printed color misregistrations were found even in the 3000th copy.

COMPARATIVE EXAMPLE 6

Example 18 was repeated in the same manner as described except that the polyurethane rubber sheet was not treated at all with the sander so that the sheet had I(S) of 0.4. The average roughness was measured to give Ra of 0.4 μm. Color printing defects attributed to printed color misregistrations were observed in the 3000th copy.

EXAMPLE 19

Preparation of Guide:

One side of a polyurethane rubber sheet having a thickness of 0.7 mm and a rubber hardness of 72.5 was treated with a sander. The thus treated surface of the rubber sheet was measured for surface roughness at 10 points Rz using a surface roughness meter (Surfcom 1400A, made by Tokyo Seimitsu K.K.) to reveal that Rz was 4.8 μm. A curable urethane-vinyl chloride copolymer-based primer was applied to the treated surface of the sheet so that the primer layer had a thickness of about 5 μm after drying. An acrylate-based adhesive agent to which 5% by weight of a curing agent had been added was then applied to the primer layer of the sheet and dried at 80–100° C. for 5 minutes to form an adhesive layer having a thickness of about 30 μm. After the adhesive layer had been covered with a releasable paper, the sheet was cut along the above-mentioned predetermined direction using a punch provided with a Thomson blade to obtain guides each having width of 4 mm.

Preparation of Endless Belt Photoconductor:

Using an endless seamless nickel belt having Vickers hardness of 480–510, a purity of 99.2% or more, a peripheral length of 290.3 mm and a thickness of 30 μm, an endless belt photoconductor was prepared.

15 Parts by weight of a commercially available alkyd resin (Trademark "Beckolite M6401-50", made by Dainippon Ink & Chemicals, Incorporated) with a solid content of 50 wt. %, and 10 parts by weight of a commercially available melamine resin (Trademark "Super Beckamine L-121-60", made by Dainippon Ink & Chemicals, Incorporated) with a nonvolatile content of 60 wt. % were dissolved in 31.7 parts by weight of methyl ethyl ketone, to which 50 parts by weight of titanium oxide particles (Trademark "CR-60", made by Ishihara Sangyo Kaisha, Ltd.) was added. The resultant mixture was dispersed in a ball mill for 72 hours using alumina balls having a diameter of 10 mm. To the thus milled mixture, 105.0 parts by weight of cyclohexanone was added and the mixture was milled for 2 hours to obtain a coating liquid for an undercoat layer.

The coating liquid was applied by spray coating to an outer surface of the nickel seamless belt and dried at 135° C. for 25 minutes to form an undercoat layer having a thickness of 6.5 μm thereon.

1.0 Part by weight of a butyral resin (S-LEC BLS, made by Sekisui Chemical Co., Ltd.) was dissolved in 80 parts by weight of cyclohexanone. To the solution were added 1.5 parts by weight of a tris-azo pigment having a structure represented by the following structural formula (1) and 1.5 parts by weight of a bis-azo pigment having a structure represented by the following formula (2).

(1)

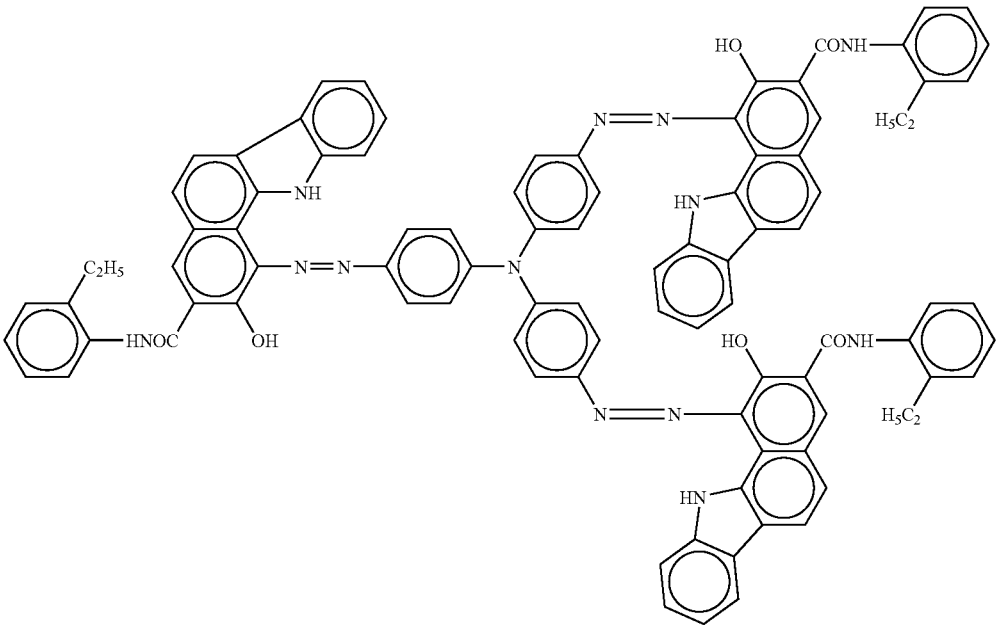

(2)

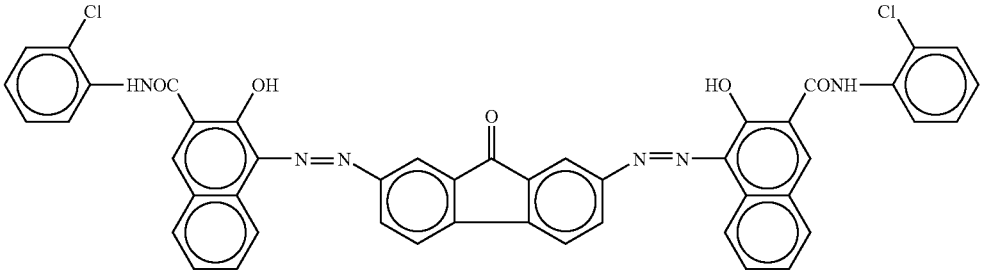

The mixture was milled in a ball mill for 1 hour using alumina balls having a diameter of 10 mm. The milled mixture was diluted with 78.4 parts by weight of cyclohexanone and 237.6 parts by weight of methyl ethyl ketone to a coating liquid for a charge generating layer. The charge generating layer coating liquid was then applied by spray coating to the undercoat layer of the nickel seamless belt and then dried at 130° C. for 20 minutes to form a charge generating layer having a thickness of about 0.12 μm.

7 Parts of a charge transporting material having a structure represented by the following structural formula (4), 10 parts of a polycarbonate resin (C-1400, made by Teijin Chemicals, Ltd.), 0.002 parts of a silicone oil (KF-50, made by Shin-Etsu Chemical Co., Ltd.), 841.5 parts by weight of tetrahydrofuran, 841 parts by weight of cyclohexanone and 0.04 part by weight of 3-t-butyl-4-hydroxyanisol were mixed to obtain a coating liquid for a charge transporting layer.

(4)

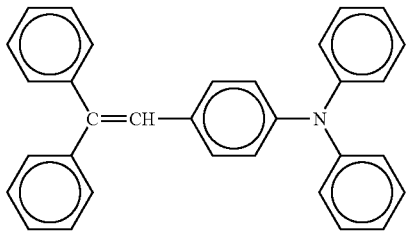

The coating liquid for a charge transporting layer was applied to the above charge generating layer by spray immersion coating and dried at 140° C. for 30 minutes to form a charge transporting layer having a thickness of about 25 μm on the charge generating layer. The thus obtained endless sheet was cut into a width of 367 mm to obtain an endless body having a photoconductive layer on an exterior surface thereof.

Each of the two guides obtained above was obliquely cut at both ends. While removing the releasable paper, the guides were bonded, along the side edges, to an interior peripheral surface of the endless body at positions inwardly spaced apart by 5 mm from respective side edges of the endless body, thereby obtaining an endless belt photoconductor as shown in FIG. 1 in which the adhesive layer of each of the guides was in contact with the interior surface of the endless body. A gap of about 1 mm was defined between the both ends of each of the fixed guides.

Image Formation:

The endless belt photoconductor was incorporated in an image forming machine (IPSIO Color 5000 manufactured by Ricoh Company, Ltd.; resolution of writing image: 600 dpi; linear speed of the endless belt photoconductor: 96 mm/sec). A color image composed of a plurality of color square patterns (1 cm×1 cm) contiguously arranged in a matrix form was reproduced to obtain 30,000 copies. Images of 10th, 2000th, 5000th, 10000th and 30000th copies were evaluated for color printing defects attributed to printed color misregistrations. No color printing defects were found even in the 30000th copy.

EXAMPLE 20

Example 19 was repeated in the same manner as described except that the conditions of the treatment of the polyurethane rubber sheet with the sander were varied so that the treated sheet had a surface roughness at 10 points Rz of 8.9 μm. No color printing defects attributed to printed color misregistrations were found even in the 30000th copy.

EXAMPLE 21

Example 19 was repeated in the same manner as described except that the conditions of the treatment of the polyurethane rubber sheet with the sander were varied so that the treated sheet had a surface roughness at 10 points Rz of 3.4 μm. No color printing defects attributed to printed color misregistrations were found even in the 30000th copy.

EXAMPLE 22

Example 19 was repeated in the same manner as described except that the image forming machine (IPSIO Color 5000) was modified so that the resolution of writing image was 1200 dpi. No color printing defects attributed to printed color misregistrations were found even in the 30000th copy.

COMPARATIVE EXAMPLE 7

Example 22 was repeated in the same manner as described except that the polyurethane rubber sheet was not treated at all with the sander so that the sheet had a surface roughness at 10 points Rz of 2.7 μm. No color printing defects attributed to printed color misregistrations were found even in the 5000th copy. However, color printing defects attributed to printed color misregistrations were observed in the 10000th copy.

EXAMPLE 23

One side of a polyurethane rubber sheet containing 10% by weight of carbon black and having a thickness of 0.7 mm and a rubber hardness of 69.8 was treated with a sander. The surface of the thus treated sheet was measured for a surface roughness at 10 points Rz using a surface roughness meter (Surfcom 1400A, made by Tokyo Seimitsu K.K.) to reveal that Rz was 4.3 μm. Using the thus treated rubber sheet, an endless belt photoconductor was prepared in the same manner as that in Example 19. The endless belt photoconductor was tested in the same manner as that in Example 22. No color printing defects attributed to printed color misregistrations were found even in the 30000th copy.

EXAMPLE 24

Example 23 was repeated in the same manner as described except that the conditions of the treatment of the polyurethane rubber sheet with the sander were varied so that the treated sheet had a surface roughness at 10 points Rz of 6.8 μm. No color printing defects attributed to printed color misregistrations were found even in the 30000th copy.

EXAMPLE 25

One side of a polyurethane rubber sheet containing 5% by weight of carbon black and having a thickness of 0.7 mm and a rubber hardness of 59.5 was treated with a sander. The surface of the thus treated sheet was measured for a surface roughness at 10 points Rz using a surface roughness meter (Surfcom 1400A, made by Tokyo Seimitsu K.K.) to reveal that Rz was 3.4 μm. Using the thus treated rubber sheet, an endless belt photoconductor was prepared in the same manner as that in Example 19. The endless belt photoconductor was tested in the same manner as that in Example 22. No color printing defects attributed to printed color misregistrations were found in the 2000th copy.

EXAMPLE 26

Example 24 was repeated in the same manner as described except that the image forming machine (IPSIO Color 5000) was modified so that the running speed of the endless belt photoconductor was increased to 160 mm/sec. No color printing defects attributed to printed color misregistrations were found even in the 30000th copy.

COMPARATIVE EXAMPLE 8

One side of a polyurethane rubber sheet having a thickness of 0.7 mm and a rubber hardness of 95.7 was treated with a sander. The surface of the thus treated sheet was measured for a surface roughness at 10 points Rz using a surface roughness meter (Surfcom 1400A, made by Tokyo Seimitsu K.K.) to reveal that Rz was 16.8. Using the thus treated rubber sheet, an endless belt photoconductor was prepared in the same manner as that in Example 19. The endless belt photoconductor was tested in the same manner as that in Example 22. Color printing defects attributed to printed color misregistrations began occurring in the 10th copy. In the 91st copying operation, the endless belt disengaged from the drive rollers so that further operation was not able to continue.

EXAMPLE 27

One side of a polyurethane rubber sheet having a thickness of 0.7 mm and a rubber hardness of 68.0 was treated with a sander. The surface of the thus treated sheet was measured for a surface roughness at 10 points Rz using a surface roughness meter (Surfcom 1400A, made by Tokyo Seimitsu K.K.) to reveal that Rz was 4.2. The surface of the treated sheet was also measured for average roughness Ra to reveal that Ra was 0.4 μm. Using the thus treated rubber sheet, an endless belt photoconductor was prepared in the same manner as that in Example 19. The endless belt photoconductor was tested in the same manner as that in Example 22. No color printing defects attributed to printed color misregistrations were found even in the 3000th copy.

COMPARATIVE EXAMPLE 9

Example 27 was repeated in the same manner as described except that the polyurethane rubber sheet was not treated at all with the sander so that the sheet had a surface roughness at 10 points Rz of 2.9 μm. The average roughness was measured to give Ra of 0.4 μm. Color printing defects attributed to printed color misregistrations were observed in the 3000th copy.

EXAMPLE 28

Preparation of Guide:

One side of a polyurethane rubber sheet having a thickness of 0.7 mm and a rubber hardness of 74.0 was treated with a sander. The thus treated surface of the rubber sheet was measured for a surface roughness at 10 points Rz using a surface roughness meter (Surfcom 1400A, made by Tokyo Seimitsu K.K.) to reveal that Rz was 7.8 μm. A curable urethane-vinyl chloride copolymer-based primer was applied to the non-treated surface of the sheet so that the primer layer had a thickness of about 5 μm after drying. An acrylate-based adhesive agent to which 5% by weight of a curing agent had been added was then applied to the primer layer of the sheet and dried at 80–100° C. for 5 minutes to form an adhesive layer having a thickness of about 30 μm. After the adhesive layer had been covered with a releasable paper, the sheet was cut along the above-mentioned predetermined direction using a punch provided with a Thomson blade to obtain guides each having width of 4 mm.

Preparation of Endless Belt Photoconductor:

Using the thus obtained guides, an endless belt photoconductor as shown in FIG. 3 was prepared in the same manner as that in Example 19.

Image Formation:

The endless belt photoconductor was tested for color printing defects attributed to printed color misregistrations in the same manner as described in Example 19. No color printing defects were found even in the 30000th copy.

EXAMPLE 29

Example 28 was repeated in the same manner as described except that the conditions of the treatment of the polyurethane rubber sheet with the sander were varied so that the treated sheet had a surface roughness at 10 points Rz of 19.2 μm. No color printing defects attributed to printed color misregistrations were found even in the 30000th copy.

EXAMPLE 30

Example 28 was repeated in the same manner as described except that the conditions of the treatment of the polyurethane rubber sheet with the sander were varied so that the treated sheet had a surface roughness at 10 points Rz of 6.1 μm. No color printing defects attributed to printed color misregistrations were found even in the 30000th copy.

EXAMPLE 31

Example 28 was repeated in the same manner as described except that the image forming machine (IPSIO Color 5000) was modified so that the resolution of writing image was 1200 dpi. No color printing defects attributed to printed color misregistrations were found even in the 30000th copy.

COMPARATIVE EXAMPLE 10

Example 31 was repeated in the same manner as described except that the polyurethane rubber sheet was not treated at all with the sander so that the sheet had a surface roughness at 10 points Rz of 1.7 μm. No color printing defects attributed to printed color misregistrations were found even in the 5000th copy. However, color printing defects attributed to printed color misregistrations were observed in the 10000th copy.

EXAMPLE 32

One side of a polyurethane rubber sheet containing 10% by weight of carbon black and having a thickness of 0.7 mm and a rubber hardness of 68.7 was treated with a sander. The surface of the thus treated sheet was measured for a surface roughness at 10 points Rz using a surface roughness meter (Surfcom 1400A, made by Tokyo Seimitsu K.K.) to reveal that Rz was 6.1 μm. Using the thus treated rubber sheet, an endless belt photoconductor was prepared in the same manner as that in Example 10. The endless belt photoconductor was tested in the same manner as that in Example 31. No color printing defects attributed to printed color misregistrations were found even in the 30000th copy.

EXAMPLE 33

Example 32 was repeated in the same manner as described except that the conditions of the treatment of the polyurethane rubber sheet with the sander were varied so that the treated sheet had a surface roughness at 10 points Rz of 10.8 μm. No color printing defects attributed to printed color misregistrations were found even in the 30000th copy.

EXAMPLE 34

One side of a polyurethane rubber sheet containing 1% by weight of carbon black and having a thickness of 0.7 mm and a rubber hardness of 56.5 was treated with a sander. The surface of the thus treated sheet was measured for a surface roughness at 10 points Rz using a surface roughness meter (Surfcom 1400A, made by Tokyo Seimitsu K.K.) to reveal that Rz was 2.9. Using the thus treated rubber sheet, an endless belt photoconductor was prepared in the same manner as that in Example 28. The endless belt photoconductor was tested in the same manner as that in Example 31. No color printing defects attributed to printed color misregistrations were found in the 2000th copy.

EXAMPLE 35

Example 33 was repeated in the same manner as described except that the image forming machine (IPSIO Color 5000) was modified so that the running speed of the endless belt photoconductor was increased to 160 mm/sec. No color printing defects attributed to printed color misregistrations were found even in the 30000th copy.

COMPARATIVE EXAMPLE 11

One side of a polyurethane rubber sheet having a thickness of 0.7 mm and a rubber hardness of 90.7 was treated with a sander. The surface of the thus treated sheet was measured for a surface roughness at 10 points Rz using a surface roughness meter (Surfcom 1400A, made by Tokyo Seimitsu K.K.) to reveal that Rz was 20.9 μm. Color printing defects attributed to printed color misregistrations began occurring in the 7th copy. In the 59th copying operation, the endless belt disengaged from the drive rollers so that further operation was not able to continue.

EXAMPLE 36

One side of a polyurethane rubber sheet containing 0.5 by weight of carbon black and having a thickness of 0.7 mm and a rubber hardness of 69.0 was treated with a sander. The surface of the thus treated sheet was measured for a surface roughness at 10 points Rz using a surface roughness meter (Surfcom 1400A, made by Tokyo Seimitsu K.K.) to reveal that Rz was 4.0 μm. The surface of the treated sheet was also measured for average roughness Ra to reveal that Ra was 0.4 μm. Using the thus treated rubber sheet, an endless belt photoconductor was prepared in the same manner as that in Example 28. The endless belt photoconductor was tested in the same manner as that in Example 31. No color printing defects attributed to printed color misregistrations were found even in the 3000th copy.

COMPARATIVE EXAMPLE 12

Example 36 was repeated in the same manner as described except that the polyurethane rubber sheet was not treated at all with the sander so that the sheet had a surface roughness at 10 points Rz of 1.9 μm. The average roughness was measured to give Ra of 0.4 μm. Color printing defects attributed to printed color misregistrations were observed in the 3000th copy.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Applications No. 2001-170111 filed Jun. 5, 2001, No. 2001-172671 filed Jun. 7, 2001, No. 2001-150955 filed May 21, 2001 and No. 2001-151074 filed May 21, 2001, inclusive of the specifications, claims and drawings, are hereby incorporated by reference herein.

What is claimed is:

1. An endless belt comprising an endless body having opposite side edges and an interior surface, and a pair of spaced apart parallel guides bonded through an adhesive layer to the interior surface of said endless body at a position adjacent to a respective side edge thereof and extending longitudinally along said side edges, wherein each of said guides is made of an elastic material and has an outside surface having Rz' of 2–20 μm, wherein Rz' is an average surface roughness at ten points of a sectional curve obtained by measuring a profile of the outside surface of said guide in the longitudinal direction of said guide, wherein each of said adhesive layers has a thickness of 5–100 μm, and wherein each of said guides has a rubber hardness of 60–90.

2. An endless belt and roller structure comprising a plurality of rollers, and an endless belt according to claim 1 supported by said rollers, so that by rotation of said rollers, the endless belt runs in the longitudinal direction of said guides with a side surface of each of said guides being in contact with a side surface of each of said rollers, and wherein said rollers are driven so that the endless belt runs in the longitudinal direction of said guides at a rate of 80 mm/sec or more.

3. An image forming apparatus comprising an endless belt and roller structure according to claim 2.

4. The endless belt according to claim 1, wherein each of said guides contains one or more fillers dispersed therein.

5. The endless belt according to claim 1, wherein each of said guides contains a carbon filler.

6. The endless belt according to claim 1, wherein the outer surface of each of the guides has been mechanically roughened.

7. The endless belt according to claim 1, wherein the interior surface of the endless body comprises nickel metal.

8. The endless belt according to claim 7, wherein the nickel is in the form of a foil and has a Vickers hardness of 400–650 and a nickel content of at least 98%.

9. The endless belt according to claim 1, wherein the endless body has a photoconductive layer on the exterior surface.

10. The endless belt according to claim 1, wherein the adhesive layers have a thickness of from 10 to 80 μm.

11. The endless belt according to claim 1, wherein the adhesive layers have a thickness of from 20 to 70 μm.

12. The endless belt according to claim 1, wherein the adhesive layer comprises at least one selected from the group consisting of an acrylic resin adhesive, a natural rubber adhesive, a synthetic rubber adhesive, a silicone resin adhesive and a thermoplastic adhesive.

13. The endless belt according to claim 1, wherein the adhesive layer comprises an acrylic resin adhesive.

14. The endless belt according to claim 1, further comprising a primer between the guide and the adhesive layer.

15. The endless belt of claim 14, wherein the primer is a curable urethane primer.

16. The endless belt according to claim 1, wherein the guide is in direct contact with the adhesive layer and the adhesive layer is in direct contact to the endless body.

* * * * *